US007016637B2

(12) United States Patent
Senda

(10) Patent No.: US 7,016,637 B2
(45) Date of Patent: Mar. 21, 2006

(54) THERMAL FIXING DEVICE AND IMAGE FORMING APPARATUS

(75) Inventor: Seiichi Senda, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 135 days.

(21) Appl. No.: 10/806,159

(22) Filed: Mar. 23, 2004

(65) Prior Publication Data

US 2004/0190956 A1 Sep. 30, 2004

(30) Foreign Application Priority Data

Mar. 25, 2003 (JP) ..... 2003-083496

(51) Int. Cl.
*G03G 15/20* (2006.01)

(52) U.S. Cl. ..... 399/328; 399/330

(58) Field of Classification Search ..... 399/328, 399/329, 330, 216, 60, 69
See application file for complete search history.

(56) References Cited

U.S. PATENT DOCUMENTS 4,568,275 A * 2/1986 Sakurai ..... 432/60
5,255,060 A 10/1993 Chikano ..... 399/328
5,854,465 A * 12/1998 Kishi et al. ..... 219/216
6,137,087 A * 10/2000 Tomatsu ..... 219/216
6,137,969 A * 10/2000 Tsujimoto ..... 399/69
6,654,585 B1 * 11/2003 Hattori ..... 399/328
6,671,488 B1 * 12/2003 Izawa et al. ..... 399/329
6,697,597 B1 * 2/2004 Senda ..... 399/330

FOREIGN PATENT DOCUMENTS

| | | |
|---|---|---|
| JP | A 55-29822 | 3/1980 |
| JP | A 5-6118 | 1/1993 |
| JP | A 6-250542 | 9/1994 |
| JP | A 6-258970 | 9/1994 |

* cited by examiner

*Primary Examiner*—Brij B. Shrivastav
(74) *Attorney, Agent, or Firm*—Oliff & Berridge, PLC

(57) ABSTRACT

A thermal fixing device includes: a heating member configured to be in contact with a fixation medium; a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

18 Claims, 9 Drawing Sheets

THERMAL FIXING DEVICE AND IMAGE FORMING APPARATUS

BACKGROUND OF THE INVENTION

1. Field of the Invention

The present invention relates to a thermal fixing device and an image forming apparatus including the thermal fixing device.

2. Description of the Related Art

An image forming apparatus such as a laser printer is generally provided with a thermal fixing device including a heat roller and a pressure roller, and a toner transferred onto a sheet is thermally fixed during a period when the sheet passes through between the heat roller and the pressure roller.

In such a thermal fixing device, there is known one in which in order to increase a contact area between a heat roller and a sheet and to achieve quick and certain fixation, plural pressure rollers are provided in a conveyance direction of the sheet.

However, when the plural pressure rollers are provided, as the contact area of the sheet with the heat roller is increased, a curved portion along the curvature of the heat roller is increased. Thus, there is a disadvantage that for example, in the case where an envelope formed of a double paper or the like is fixed, a shift in the amount of conveyance occurs between its front sheet coming in contact with the heat roller and its back sheet coming in contact with the pressure roller, and wrinkles are apt to occur.

Thus, for example, JP-A-5-006118 proposes that a nip width of each of pressure rollers to a fixing roller is made 2.5 mm or less to prevent wrinkles from occurring when an envelope is fixed.

SUMMARY OF THE INVENTION

However, even if the nip width of each of the pressure rollers is made 2.5 mm or less, it is insufficient to prevent the occurrence of wrinkles. Especially, it is insufficient to prevent wrinkles from occurring from both ends of the sheet in the width direction toward the center part, and when the number of the pressure rollers becomes two or more, such wrinkles are increased by a difference in conveyance force between the respective pressure rollers, and excellent fixation is hindered.

One of objects of the invention is to provide a thermal fixing device that can prevent the occurrence of wrinkles of a fixation medium, and an image forming apparatus including the thermal fixing device.

In order to achieve the above object, according to a first aspect of the invention, there is provided a thermal fixing device including: a heating member configured to be in contact with a fixation medium; a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

According to a second aspect of the invention, there is provided a thermal fixing device including: a heating member configured to be in contact with a fixation medium; a first pressing roller disposed to face the heating member and presses the fixation medium to the heating member, the first pressing roller having a second outer diameter at both end parts thereof, is in a direction orthogonal to the conveyance direction, of an area where the fixation medium having a maximum size in which to be in contact with the first pressing roller, the second outer diameter being larger than a first outer diameter at a center part thereof; and a second pressing roller disposed to face the heating member at a position downstream in the conveyance direction with respect to the first pressing roller and presses the fixation medium to the heating member, the second pressing roller having a second outer diameter at both end parts thereof, in the direction orthogonal to the conveyance direction, of an area where the fixation medium having a maximum size in which to be in contact with the second pressing roller, the second outer diameter being larger than a first outer diameter at a center part thereof, wherein a difference between the first outer diameter and the second outer diameter of the second pressing roller is larger than a difference between the first outer diameter and the second outer diameter of the first pressing roller.

According to a third aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a heating member configured to be in contact with the fixation medium; a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

According to a fourth aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a heating member configured to be in contact with a fixation medium; a first pressing roller disposed to face the heating member and presses the fixation medium to the heating member, the first pressing roller having a second outer diameter at both end parts thereof, in a direction orthogonal to the conveyance direction, of an area where the fixation medium having a maximum size in which to be in contact with the first pressing roller, the second outer diameter being larger than a first outer diameter at a center part thereof; and a second pressing roller disposed to face the heating member at a position downstream in the conveyance direction with respect to the first pressing roller and presses the fixation medium to the heating member, the second pressing roller having a second outer diameter at both end parts thereof, in the direction orthogonal to the conveyance direction, of an area where the fixation medium having a maximum size in which to be in contact with the second pressing roller, the second outer diameter being larger than a first outer diameter at a center part thereof, wherein a difference between the first outer diameter and the second outer diameter of the second pressing roller is larger than a difference between the first outer diameter and the second outer diameter of the first pressing roller.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of a preferred embodiment of the invention.

Figure 1:
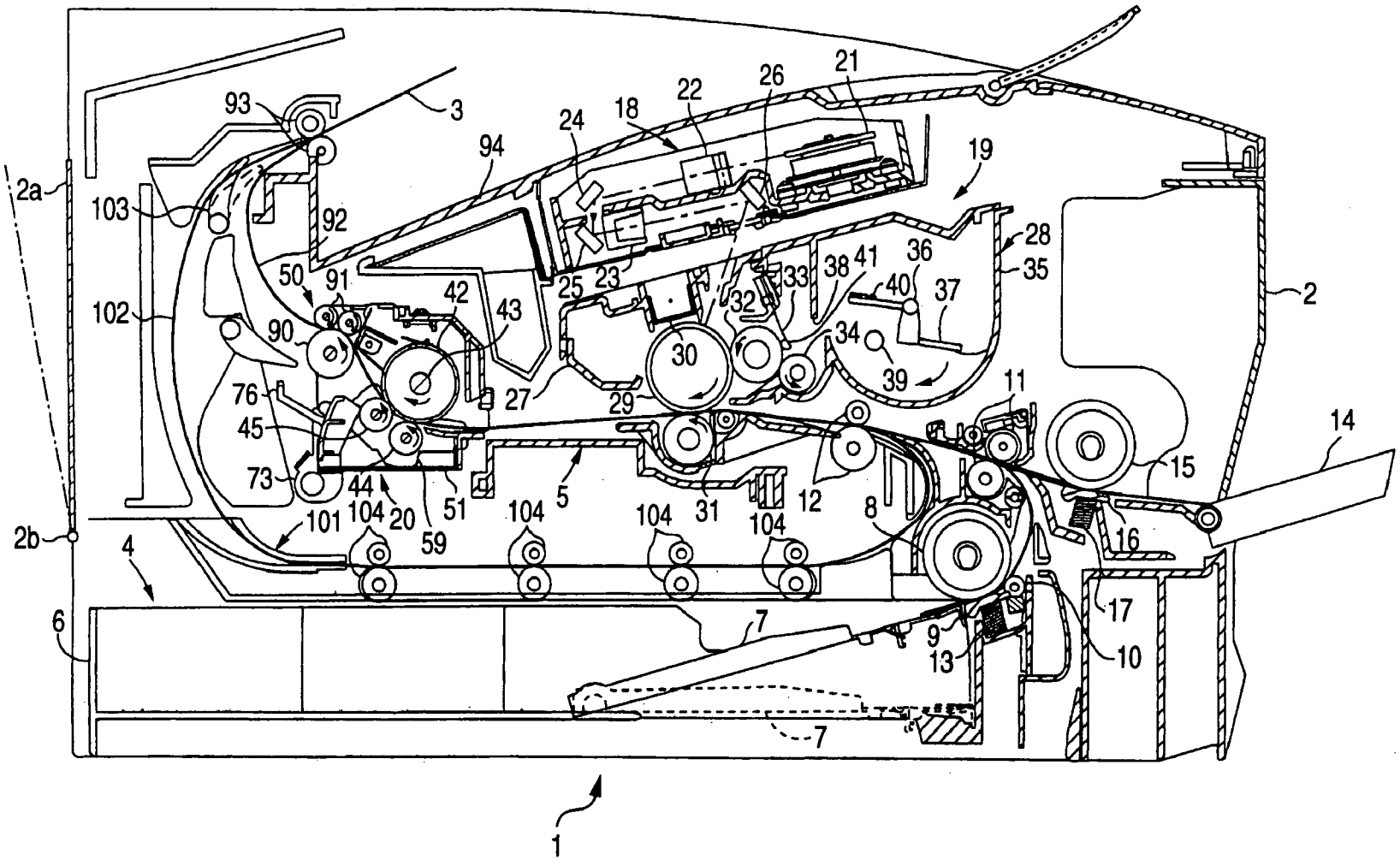
FIG. 1 is a main part side sectional view showing an embodiment of a laser printer as an image forming apparatus of the invention.

FIG. 1 is a main part side sectional view showing an embodiment of a laser printer as an image forming apparatus of the invention. In FIG. 1, a laser printer 1 includes a sheet feeding section 4 for feeding a sheet 3 as a fixation medium, an image forming section 5 for forming an image on the fed sheet 3, and the like in a main body casing 2.

In the following description, as to the main body casing 2, a side where a multipurpose tray 14 is provided is called a front side, and a side where a rear cover 2*a* is provided is called a rear side.

The sheet feeding section 4 includes a sheet feed tray 6, a sheet press plate 7 provided in the sheet feed tray 6, a sheet feed roller 8 and a sheet feed pat 9 which are provided above one end side end part of the sheet feed tray 6, paper dust removal rollers 10 and 11 provided at a downstream in a conveyance direction of the sheet 3 (hereinafter, the downstream in the conveyance direction of the sheet 3 is simply referred to as "conveyance direction downstream", and the upstream side in the conveyance direction of the sheet 3 is simply referred to as "conveyance direction upstream side", and a description will be made) with respect to the sheet feed roller 8, and a registration roller 12 provided at the conveyance direction downstream with respect to the paper dust removal rollers 10 and 11.

The sheet press plate 7 can be stacked with the sheets 3 in a laminate state, and is swingably supported at a farther end with respect to the sheet feed roller 8 so that a nearer end can be moved vertically, and is urged upward by a not-shown spring from its backside. Thus, as the amount of stacking of the sheets 3 is increased, the sheet press plate 7 is swung downward against the urging force of the spring, while the farther end with respect to the sheet feed roller 8 is made a fulcrum. The sheet roller 8 and the sheet pat 9 are disposed to face each other, and the sheet feed pat 9 is pressed to the sheet feed roller 8 by a spring 13 provided at the backside of the paper sheet pat 9.

The uppermost sheet 3 on the sheet press plate 7 is pressed toward the sheet roller 8 from the backside of the sheet press plate 7 by a not-shown spring, and after the sheet is held between the sheet feed roller 8 and the sheet feed pat 9, the sheet feed roller 8 is rotated, so that the sheet is fed one by one. Then, the paper dust of the fed sheet 3 is removed by the paper dust removal rollers 10 and 11, and then, the sheet is fed to the registration roller 12.

The registration roller 12 has a pair of rollers, and sends the sheet 3 to an image formation position after registration. Incidentally, the image formation position is a transfer position where a toner image on a photosensitive drum 29 is transferred to the sheet 3, and is, in this embodiment, a contact position between the photosensitive drum 29 and the transfer roller 31.

The sheet feeding section 4 includes the multipurpose tray 14, a multipurpose side sheet feed roller 15 for feeding the sheet 3 stacked on the multipurpose tray 14 and a multipurpose side sheet feed pat 16. The multipurpose side sheet feed roller 15 and the multipurpose side sheet feed pat 16 are disposed to face each other, and the multipurpose side sheet feed pat 16 is pressed to the multipurpose side sheet feed roller 15 by a spring 17 provided at the backside of the multipurpose side sheet feed pat 16. The sheet 3 stacked on the multipurpose tray 14 is held between the multipurpose side sheet feed roller 15 and the multipurpose side sheet feed pat 16 by the rotation of the multipurpose side sheet feed roller 15, and then, the sheet 3 is fed one by one. Then, the fed sheet 3 is sent to the registration roller 12 after the paper dust thereon is removed by the paper dust removal roller 11.

The image forming section 5 includes a scanner part 18, a process part 19, a fixing part 20 as a thermal fixing device, and the like.

The scanner part 18 is provided at an upper part in the main body casing 2, and includes a laser emission part (not shown), a polygon mirror 21 driven to be rotated, lenses 22 and 23, reflecting mirrors 24, 25 and 26, and the like. A laser beam emitted from the laser emission part and based on image data passes through or is reflected by the polygon mirror 21, the lens 22, the reflecting mirrors 24 and 25, the lens 23 and the reflecting mirror 26 in sequence as indicated by a chain line, and is irradiated onto the surface of the photosensitive drum 29 of the process part 19 by high speed scanning.

The process part 19 is disposed below the scanner part 18, and includes, in a drum cartridge 27 detachably mounted to the main body casing 2, a development cartridge 28, the photosensitive drum 29, a Scorotron type charging unit 30, the transfer roller 31 and the like.

The development cartridge 28 is detachably mounted to the drum cartridge 27, and includes a developing roller 32, a layer thickness regulating blade 33, a supply roller 34, a toner hopper 35 and the like.

The toner hopper 35 is filled with a positive charging nonmagnetic one-component toner. As the toner, a polymerized toner is used which is obtained by copolymerizing a polymerizable monomer, for example, styrene monomer such as styrene, or acrylic monomer such as acrylic acid, alkyl (C1 to C4) acrylate, or alkyl (C1 to C4) methacrylate by a well-known polymerization method such as suspension polymerization. The polymerized toner as stated above has roughly a spherical-letter shape and excellent fluidity. Therefore, high quality image formation can be formed by using the polymerized toner.

The toner as stated above is mixed with wax or a coloring agent such as carbon black, and is added with an additive such as silica in order to improve the fluidity. The particle diameter of the toner is in a range from 6 $\mu$m to 10 $\mu$m.

The toner in the toner hopper 35 is agitated in an arrow direction (clockwise direction) by an agitator 37 supported by a rotation shaft 36 provided at the center of the toner hopper 35, and is discharged through a toner supply port 38 opening to the supply roller 34 from the toner hopper 35. Both side walls of the toner hopper 35 are provided with windows 39 for detection of the residual amount of toner, and the residual amount of the toner in the toner hopper 35 can be detected. The window 39 is cleaned by a cleaner 40 supported by the rotation shaft 36.

The supply roller 34 is rotatably disposed at a facing position of the opposite side to the toner hopper 35 with respect to the toner supply port 38, and the developing roller 32 is rotatably disposed to face the supply roller 34. The supply roller 34 and the developing roller 32 are in contact with each other in such a state that they are respectively compressed in some degree.

The supply roller 34 is such that a roller made of conductive foam material covers a roller shaft made of metal, and is driven to be rotated in an arrow direction (counterclockwise direction) by a motor 85 (see FIG. 4) as a driving unit.

The developing roller 32 is such that a roller made of conductive rubber material covers a roller shaft made of metal. More specifically, the roller of the developing roller 32 is such that the surface of a roller main body made of conductive urethane rubber or silicone rubber containing carbon fine particles or the like is covered with a coat layer of urethane rubber containing fluorine or silicone rubber. At the time of development, a development bias is applied to the developing roller 32 from a not-shown power source, and the roller is driven to be rotated in an arrow direction (counterclockwise direction) by the motor 85 (see FIG. 4).

The layer thickness regulating blade 33 is disposed in the vicinity of the developing roller 32. The layer thickness regulating blade 33 includes a press part 41 made of insulating silicone rubber and having a semicircular section at a tip part of a blade main body made of a metal plate spring member, and is supported by the development cartridge 28 in the vicinity of the developing roller 32, and the press part 41 is provided so as to be pressed onto the developing roller 32 by the elastic force of the blade main body.

The toner discharged from the toner supply port 38 is supplied to the developing roller 32 by the rotation of the supply roller 34, and is positively charged at this time by the friction between the supply roller 34 and the developing roller 32, and further, the toner supplied onto the developing roller 32 enters between the press part 41 of the layer thickness regulating blade 33 and the developing roller 32 in accordance with the rotation of the developing roller 32, and is supported as a thin layer having a specified thickness on the developing roller 32.

The photosensitive drum 29 is rotatably supported at an opposite side to the supply roller 34 with respect to the developing roller 32 and in the drum cartridge 27. The photosensitive drum 29 includes a grounded dram main body, its surface is formed of a positively-charged photosensitive layer made of polycarbonate or the like, and the photosensitive drum is driven to be rotated in an arrow direction (clockwise direction) by the motor 85 (see FIG. 4).

The Scorotron type charging unit 30 is disposed above the photosensitive drum 29 to face it and to be spaced therefrom by a specified interval so as not to come in contact with the photosensitive drum 29. The Scorotron type charging unit 30 is a Scorotron type charging unit for positive charging and for generating corona discharge from a charging wire of tungsten or the like, and is provided to uniformly and positively charge the surface of the photosensitive drum 29 by application of voltage from a not-shown power source.

The transfer roller 31 is disposed below the photosensitive drum 29 to face the photosensitive drum 29, and is rotatably supported by the drum cartridge 27. The transfer roller 31 is such that a roller made of conductive rubber material covers a roller shaft made of metal, and at the time of transfer, a transfer bias is applied from a not-shown power source, and the transfer roller is driven to be rotated in an arrow direction (counterclockwise direction) by the motor 85 (see FIG. 4).

The surface of the photosensitive drum 29 is first charged uniformly and positively by the Scorotron type charging unit 30 with the rotation of the photosensitive drum 29, and next, an electrostatic latent image is formed by a laser beam from the scanner part 18, and then, the photosensitive drum faces the developing roller 32. When the toner supported on the developing roller 32 and positively charged faces and comes in contact with the photosensitive drum 29, the toner is supplied to the electrostatic latent image formed on the surface of the photosensitive drum 29, that is, to the exposed portion of the uniformly positively charged photosensitive drum 29, which is exposed by the laser beam and whose potential is lowered, and the toner is selectively supported, so that the toner image is formed on the surface of the photosensitive drum 29. As a result, reversal development is achieved.

Thereafter, the toner image supported on the surface of the photosensitive drum 29 is transferred to the sheet 3 by a transfer bias applied to the transfer roller 31 while the sheet 3 passes through between the photosensitive drum 29 and the transfer roller 31.

Figure 2:
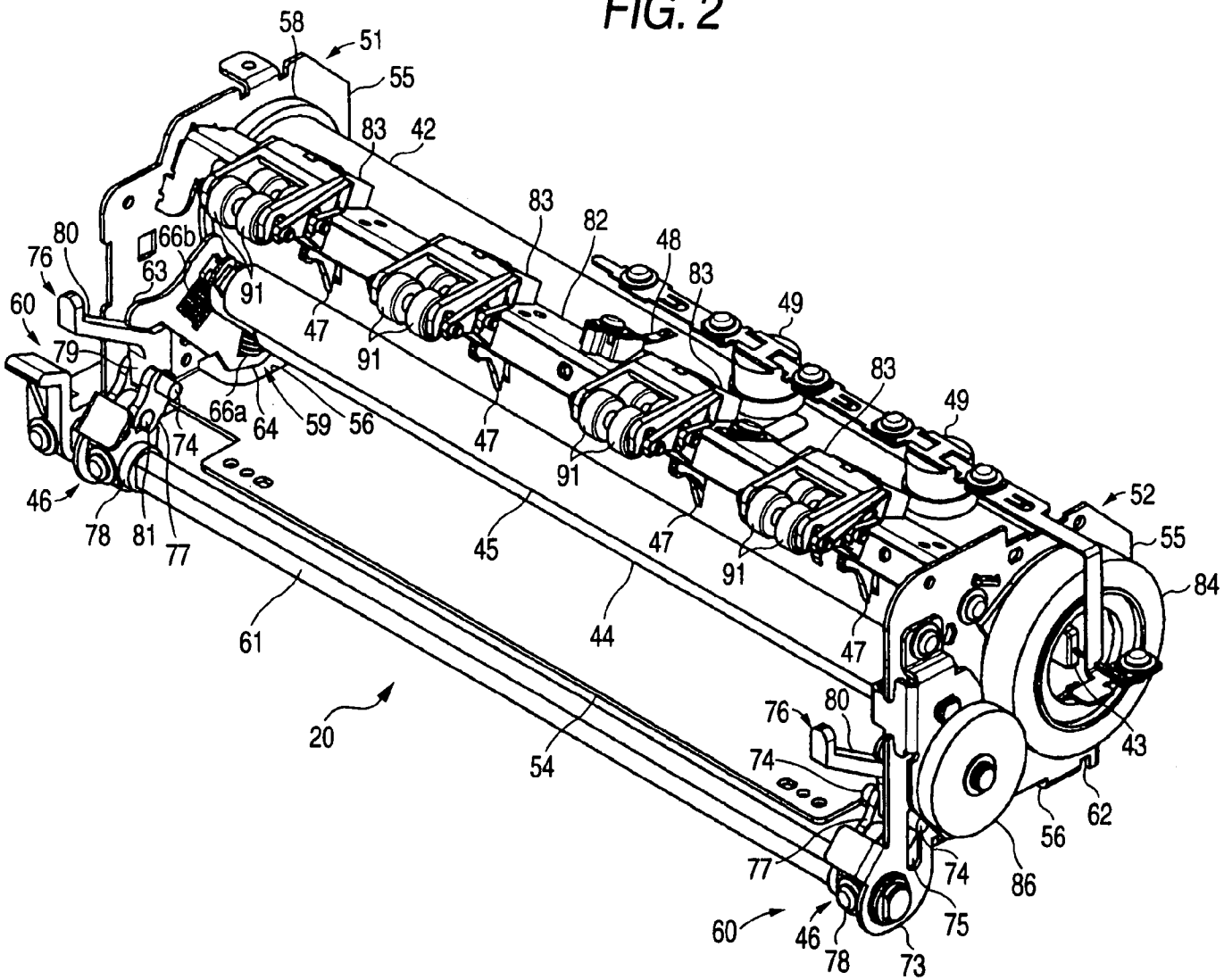
FIG. 2 is a main part perspective view showing a state where an upper frame of a fixing part of the laser printer shown in FIG. 1 is removed.
Figure 4:
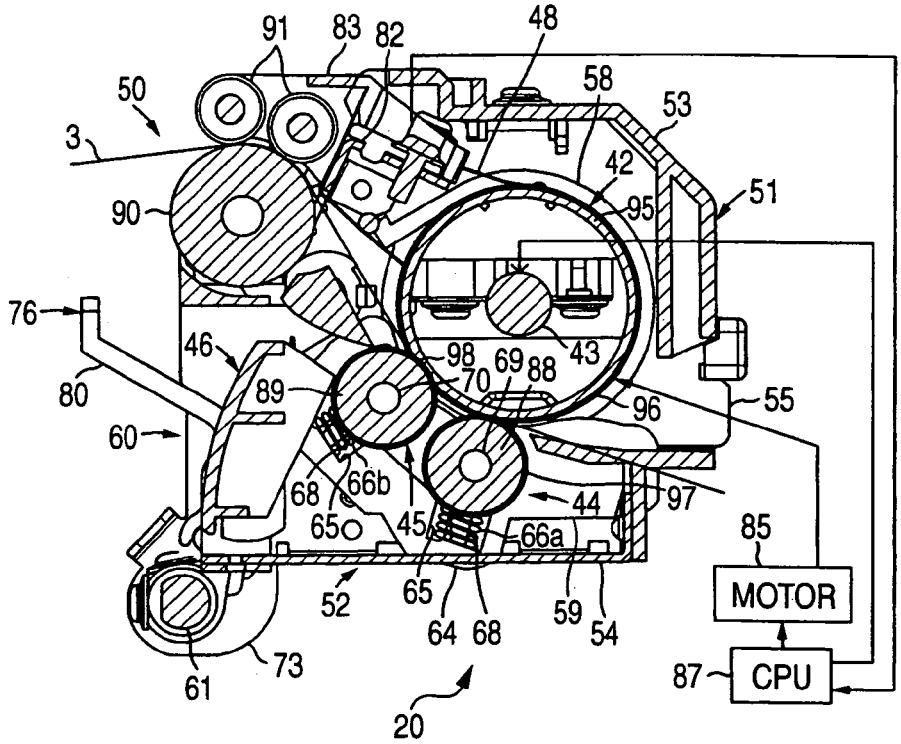
FIG. 4 is a sectional view (normal mode) corresponding to line IV—IV of FIG. 3.
Figure 5:
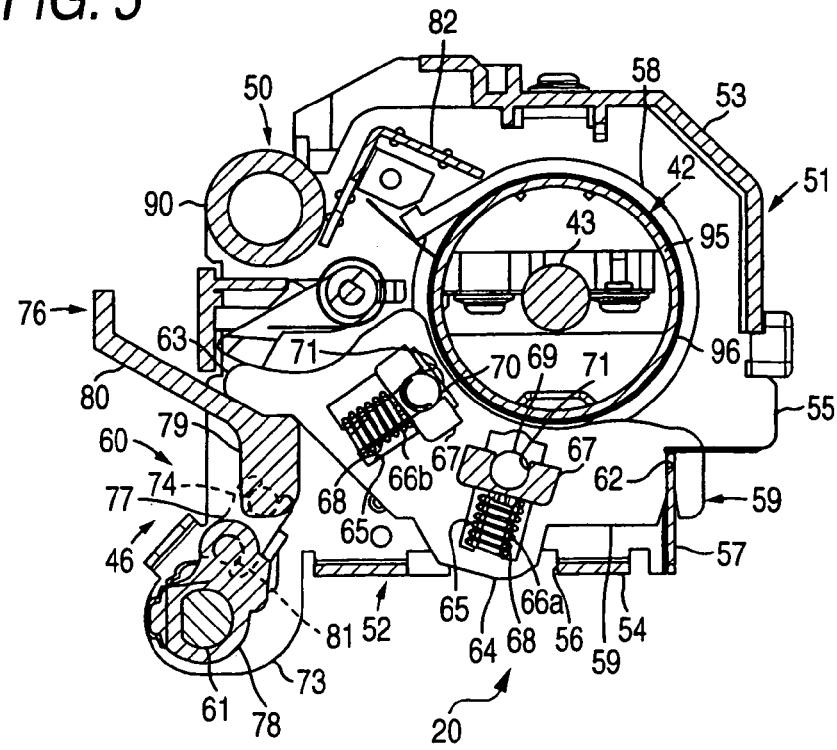
FIG. 5 is a sectional view (normal mode) corresponding to line V—V of FIG. 3.

The fixing part 20 is disposed at the conveyance direction downstream with respect to the process part 19, and includes, as shown in FIGS. 2, 4 and 5, a heat roller 42 as a fixing member and a fixing roller, a fixing heater 43 as a heating unit, a first pressure roller 44 as a first pressing member, a second pressure roller 45 as a second pressing member, a pressure changeover mechanism part 46 as a changeover unit, plural (four, in the embodiment) peeling pawls 47, a thermistor 48 as a temperature detecting unit, plural (two, in the embodiment) thermostats 49, and a conveyance mechanism part 50, and these are supported by a fixation frame 51.

Figure 3:
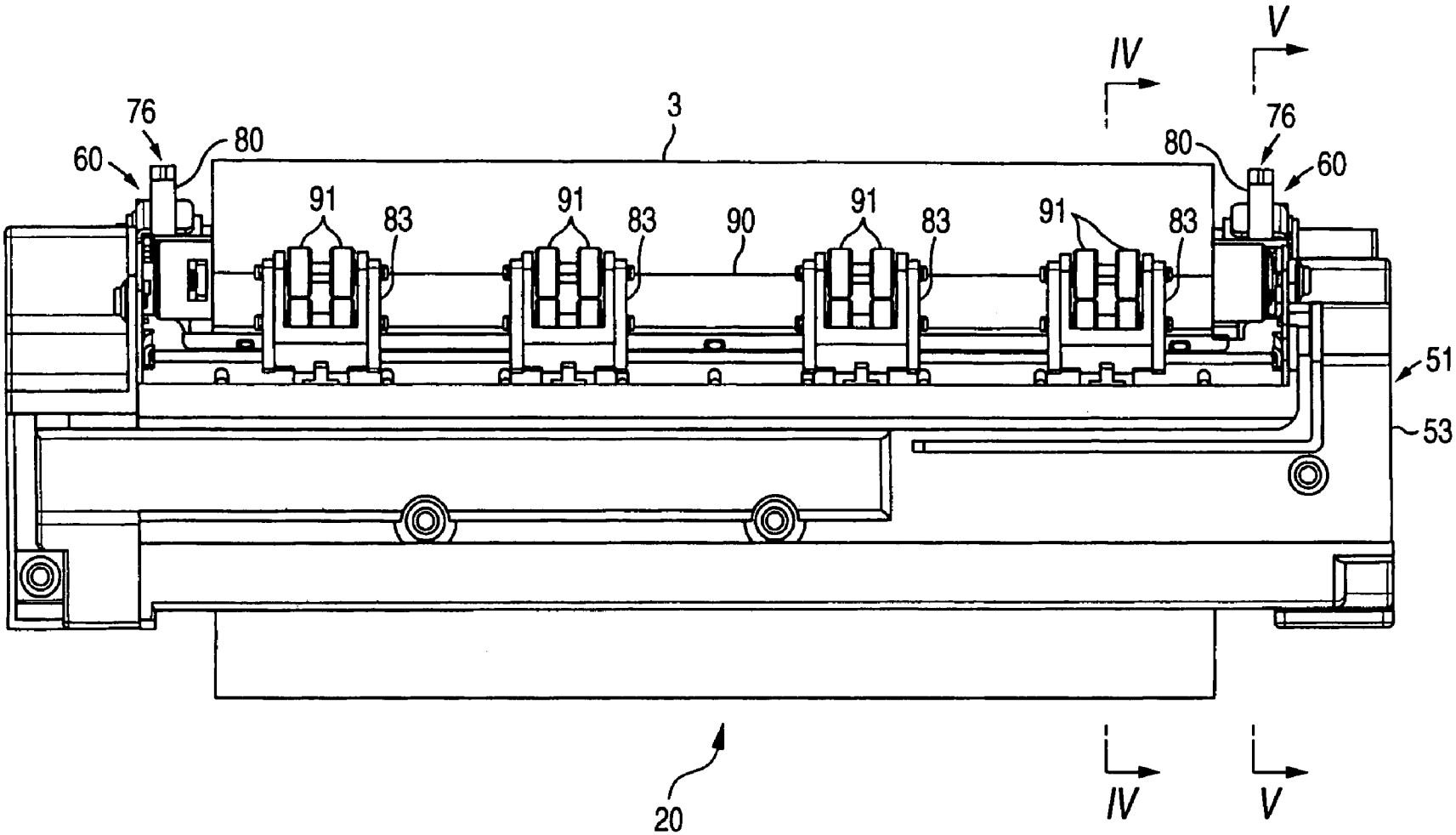
FIG. 3 is a plan view of the fixing part shown in FIG. 2.

The fixation frame 51 includes, as shown in FIGS. 2 and 5, a lower frame 52 having substantially a C-letter shape when viewed in front, and includes, as shown in FIGS. 3 and 5, an upper frame 53 covering the lower frame 52 from above and having substantially an L-letter shape when viewed from side.

The lower frame 52 includes, as shown in FIG. 2, a bottom plate 54, and two side plates 55 standing upward from both sides of the bottom plate 54 in a width direction (direction orthogonal to a front-to-rear direction when viewed in front).

The bottom plate 54 is disposed below the heat roller 42 and along the axial direction of the heat roller 42. At both the sides of the bottom plate 54 in the width direction, as shown in FIG. 5, there are formed cutout parts 56 for receiving lower expansion parts 64 of after-mentioned holder plates 59 so as to allow their advance and retreat. At front end parts of the bottom plate 54 at both the sides in the width direction, support plates 57 as supporting members for supporting front end parts of the holder plates 59 are formed to stand upward.

The respective sideplates 55 are, as shown in FIG. 2, formed to face each other at both sides of the heat roller 42 in the axial direction, and bearing members 58 for rotatably supporting the heat roller 42 are respectively provided at the respective side plates 55. Each of the bearing members 58 is formed into a ring shape having an inner diameter corresponding to an outer diameter of the heat roller 42 so that the outer peripheral surface of the heat roller 42 can be rotatably borne. Each of the bearing members 58 is formed of a material (for example, polyphenylene sulfide: melting point of 280° C.) which is softened when the temperature exceeds the thermal fixation temperature at which the toner image transferred onto the sheet 3 is thermally fixed.

A shaft support part 73 provided with a support hole for rotatably supporting an after-mentioned interlocking shaft 61 is formed at a rear side lower end part of each of the side plates 55 so as to expand downward. Besides, a long hole 75 for slidably receiving an after-mentioned swing shaft 74 is formed in the vicinity of the front of each of the shaft support parts 73 and in the vertical direction.

An erection plate 82 laid between the respective side plates 55 is provided at the lower frame 52. The erection plate 82 has, as shown in FIG. 5, a substantially L-letter shaped section, is disposed between the heat roller 42 and an after-mentioned conveyance roller 90 in the conveyance direction of the sheet 3, and is supported, as shown in FIG. 2, between the respective side plates 55 so that its longitudinal direction is parallel to the axial direction of the heat roller 42.

Pinch roller support parts 83 for supporting after-mentioned pinch rollers 91 of the conveyance mechanism part 50 are provided at this erection plate 82. The plural (four) pinch roller support parts 83 are provided at specified intervals along the axial direction of the heat roller 42.

At the lower frame 52, a heat roller drive gear 84 externally fitted to the bearing member 58 and an input gear 86 which is disposed at the side of the heat roller drive gear 84 to engage with the heat roller drive gear 84 and to which power from the motor 85 (see FIG. 4) is inputted are provided at one of the side plates 55.

As shown in FIGS. 3 and 5, an upper frame 53 is attached to the respective side plates 55 of the lower frame 52 so as to cover the front and the upper part of the heat roller 42.

The heat roller 42 is configured such that a coating layer 96 made of fluorocarbon polymer, for example, PFA (tetrafluoroethylene-perfluoroalkyl vinyl ether copolymer) is coated on an outer peripheral surface of a metal element pipe 95 formed into a substantially cylindrical shape by the drawing of metal such as aluminum. Incidentally, in order to coat the outer peripheral surface of the metal element pipe 95 with the coating layer 96, the coating layer 96 may be coated on the outer peripheral surface of the metal element pipe 95, or the tube-like coating layer 96 may be externally fitted to the outer peripheral surface of the metal element pipe 95.

Figure 10A:
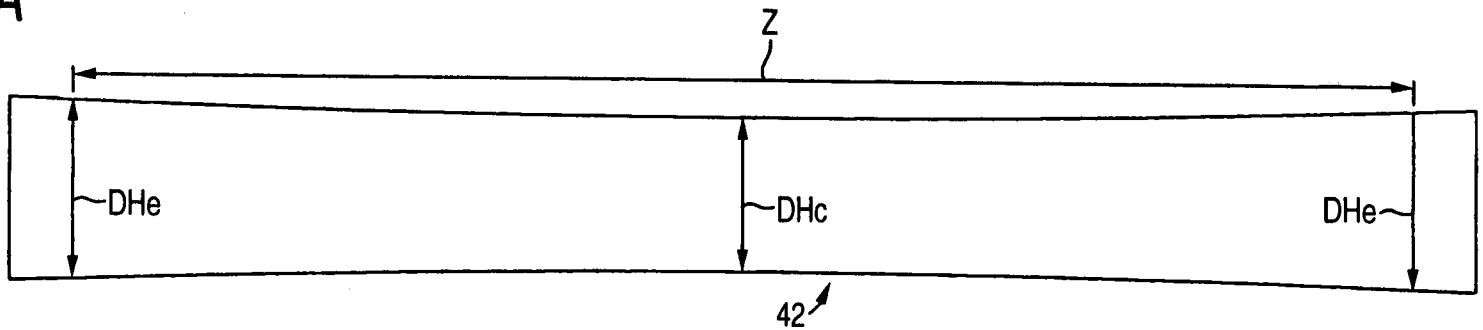
FIG. 10A is a schematic plan view of a heat roller.

The heat roller 42 is, as shown in FIG. 10A, formed into an inverted crown shape in which its outer diameter gradually becomes large from a center part in an axial direction (direction orthogonal to the conveyance direction of the sheet 3) to both end parts in the axial direction so that a heat roller both end part outer diameter DHe as a second outer diameter at both end parts, in the axial direction, of a fixation area Z where the sheet 3 (A4 horizontal size: 219 mm) having the maximum size in this laser printer 1 comes in contact becomes larger than a heat roller center part outer diameter DHc as a first outer diameter at a center part in the axial direction.

More specifically, in the heat roller 42, the whole length in the axial direction is 230 mm, the heat roller center part outer diameter DHc is 30 mm, the heat roller both end part outer diameter DHe is 30 mm+50 W, and the total thickness of the metal element pipe 95 and the coat layer 96 is 0.9 mm.

With respect to the heat roller 42, as shown in FIGS. 2 and 4, both end parts thereof in the axial direction are press inserted in the bearing members 58, and it is connected to the motor 85 through the input gear 86 and the heat roller drive gear 84 as shown in FIG. 4. Accordingly, when power is inputted from the motor 85 through the input gear 86 and the heat roller drive gear 84, the heat roller 42 is driven to be rotated in an arrow direction (clockwise direction, see FIG. 1).

The motor 85 is connected to a CPU 87, and the rotation speed of the heat roller 42 is controlled through the control of the motor 85 by the CPU 87, whereby the conveyance speed of the sheet 3 held between the heat roller 42 and the first pressure roller 44/the second pressure roller 45 is set.

The CPU 87 includes therein a ROM storing a program and a RAM temporarily storing data.

The fixing heater 43 is made of a halogen heater or the like for generating heat by applied electricity, is disposed at the axial center in the heat roller 42, and is provided along the axial direction of the heat roller 42 in order to heat the heat roller 42. The fixing heater 43 is, as shown in FIG. 4, connected to the CPU 87, the drive or stop thereof is controlled by the CPU 87, and the surface of the heat roller 42 is kept at a set thermal fixation temperature.

The first pressure roller 44 and the second pressure roller 45 are provided below the heat roller 42 so as to face the heat roller 42 and to be spaced from each other by a specified interval along the conveyance direction of the sheet 3.

The first pressure roller 44 is configured such that a first roller layer 88 made of heat resistant rubber material, for example, silicone rubber covers a first roller shaft 69 made of metal. The first roller layer 88 is coated with a first coating layer 97 made of PFA, which is the same material as the coating layer 96 of the heat roller 42, by a similar method to the coating layer 96 of the heat roller 42.

Figure 10B:
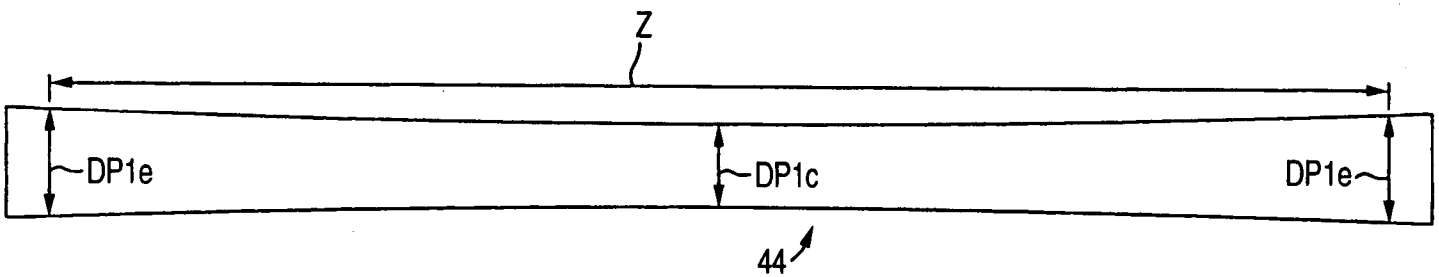
FIG. 10B is a schematic plan view of a first pressure roller.

The first pressure roller 44 is, as shown in FIG. 10B, formed into an inverted crown shape in which its outer diameter gradually becomes large from a center part in the axial direction (direction orthogonal to the conveyance direction of the sheet 3) to both end parts in the axial direction, so that a first pressure roller both end part outer diameter DP1*e* as a second outer diameter at both the end parts, in the axial direction, of the fixation area Z where the sheet 3 (A4 horizontal size: 219 mm) having the maximum size in this laser printer 1 comes in contact is larger than a first pressure roller center part outer diameter DP1*c* as a first outer diameter at the center part in the axial direction.

More specifically, in the first pressure roller 44, the whole length in the axial direction is 220 nm, the first pressure roller center part outer diameter DP1*c* is 16 mm, and the first pressure roller both end part outer diameter DP1*e* is 16 mm+50 μm. Besides, the hardness of the rubber material forming the first roller layer 88 is configured to be in a range from 50 to 55 in Asker C hardness and in a range from 0° to 10° in JIS A hardness. A friction coefficient of the first coating layer 97 to the sheet 3 is configured to be 0.35.

As to the first pressure roller 44, as described later in FIG. 5, each of axial end parts of the first roller shaft 69 is inserted in a pressure roller attachment groove 65 at the front side of each of the holder plates 59, and is held in a recess part 71 of a pressure receiving member 67. Besides, when the heat roller 42 is driven to be rotated, this first pressure roller 44 follows the rotation driving of the heat roller 42 and is rotated in a direction shown by an arrow in FIG. 1 (counterclockwise direction).

As shown in FIG. 4, the second pressure roller 45 is such that a second roller layer 89 made of heat resistant rubber materials for example, silicone rubber covers a second roller shaft 70 made of metal. The second roller layer 89 is coated with a second coating layer 98 made of PPA (tetra fluoro ethylene-PerFluoro Alkylvinyl ether copolymer), which is the same material as the coating layer 96 of the heat roller 42, by a similar method to the coating layer 96 of the heat roller 42.

Figure 10C:
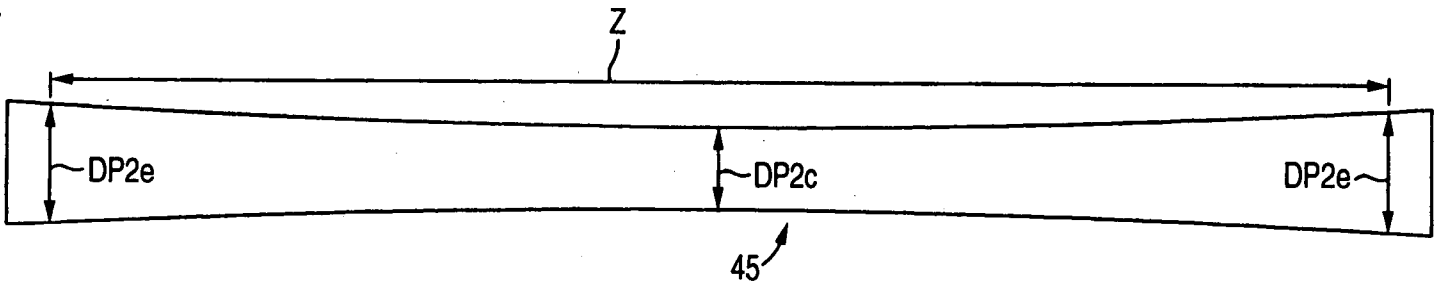
FIG. 10C is a schematic plan view of a second pressure roller, in the fixing part shown in FIG. 2.

The second pressure roller 45 is, as shown in FIG. 10C, formed into an inverted crown shape in which its otter diameter gradually becomes large from a center part in the axial direction (direction orthogonal to the conveyance direction of the sheet 3) to both end parts in the axial direction, so that a second pressure roller both end part outer diameter DP2*e* as a second outer diameter at both the end parts, in the axial direction, of the fixation area Z where the sheet 3 (A4 horizontal size: 219 mm) having the maximum size in this laser printer 1 comes in contact becomes larger than a second pressure roller center part outer diameter DP2*c* as a first outer diameter at a center part in the axial direction.

More specifically, in the second pressure roller 45, the whole length in the axial direction is 220 mm, the second pressure roller center part outer diameter DP2*c* is 16 mm, the second pressure roller both end part outer diameter DP2*e* is 16 mm+100 μm which is larger than the first roller both end part outer diameter DP1*e*. The hardness of the rubber material forming the second roller layer 89 is configured to be in a range from 50 to 55 in Asker C hardness and in a range from 0° to 10° in JIS A hardness. A friction coefficient of the surface of the second coating layer 98 to the sheet 3 is 0.6 which is larger than the friction coefficient of the surface of the first coating layer 97 to the sheet 3.

As to the second pressure roller 45, as described later in FIG. 5, each of axial end parts of the second roller shaft 70 is inserted in a pressure roller attachment groove 65 at the rear side of each of the holder plates 59, and is held in a recess part 71 of a pressure receiving member 67. When the heat roller 42 is driven to be rotated, this second pressure roller 45 follows the rotation driving of the heat roller 42 and is rotated in a direction shown by an arrow in FIG. 1 (counterclockwise direction).

As stated above, when the two rollers of the first pressure roller 44 and the second pressure roller 45 are provided for the one heat roller 42, the contact area of the sheet 3 to the heat roller 42 can be increased. Thus, the sheet 3 can be quickly fixed, and the speed-up of thermal fixation (for example, about 140 mm/sec in conveyance speed) can be realized. Besides, since the contact area of the sheet 3 to the heat roller 42 can be increased without enlarging the pressure roller, miniaturization can be realized.

As shown in FIGS. 2, 4 and 5, the pressure changeover mechanism part 46 includes the holder plates 59, operation lever parts 60, the interlocking shaft 61, and the like.

Figure 11A:
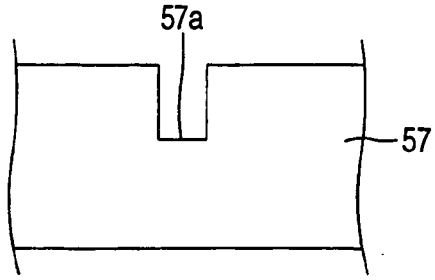
FIG. 11A is a front view of a support plate of the fixing part.
Figure 11B:
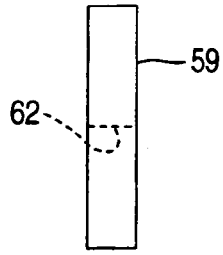
FIG. 11B is a front view of a holder plate of the fixing part.

The holder plate 59 is disposed below the heat roller 42, an upper side peripheral part thereof is formed into a curved shape along the outer peripheral surface of the heat roller 42 when viewed from side, and it is provided at each of the side plates 55. A locking groove 62 (see FIG. 11B) capable of engaging with a locked groove 57*a* (see FIG. 11A) formed in the support plate 57 of the lower frame 52 and opening to the above is formed at the front end part of each of the holder plates 59, a rear side protrusion 63 coming in contact with an after-mentioned lever 76 is formed at the rear end part thereof, and the lower expansion part 64 to be received in the cutout part 56 of the lower frame 52 is formed at the halfway lower end part in the front-to-rear direction, and they are integrally formed. The pressure roller attachment grooves 65 corresponding to the first pressure roller 44 and the second pressure roller 45 are respectively formed in the inside thereof to be spaced from each other by a specified interval in the front-to-rear direction.

Figure 7:
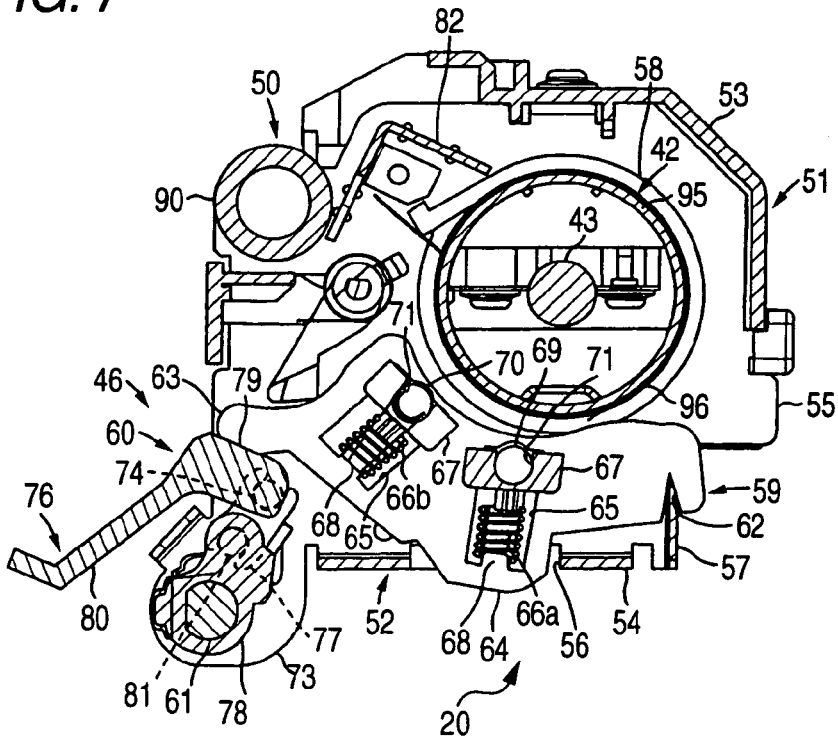
FIG. 7 is a sectional view (envelope mode) corresponding to the line V—V of FIG. 3.

The locking groove 62 is formed at the front end part to have substantially an inverted V-shape with an opened lower part when viewed from side (see FIG. 7). The rear side protrusion part 63 is formed so as to protrude from the rear end part of the holder plate 59 toward the rear side. The lower expansion part 64 is formed so as to expand from the lower end part to form a substantially rectangular shape so that the formation of the front side pressure roller attachment groove 65 can be ensured.

The respective pressure roller attachment grooves 65 are formed to be parallel to each other in the front-to-rear direction and to be spaced from each other by the specified interval in the inside of the holder plate 59.

A first spring 66*a*, a second spring 66*b* and the pressure receiving member 67 are provided in each of the pressure roller attachment grooves 65. That is, a locking projection 68 extending toward the rotation center of the heat roller 42 is provided at the deepest part in each of the pressure roller attachment grooves. 65, and the first spring 66*a* having a spring force of 3×9.8 N is externally fitted to the locking projection 68 of the front side pressure roller attachment groove 65. Besides, the second spring 66*b* having a spring force of 2×9.8 N is externally fitted to the locking projection 68 in the rear side pressure roller attachment groove 65. Besides, the recess part 71 for receiving the first roller shaft 69 of the first pressure roller 44 or the second roller shaft 70 of the second pressure roller 45 is formed in each of the pressure receiving members 67, and each of the pressure receiving members 67 is attached to the free end of each of the first spring 66*a* and the second spring 66*b*.

Each of the holder plates 59 receives the first roller shaft 69 of the first pressure roller 44 in the front side pressure roller attachment groove 65, and elastically holds the first roller shaft 69 on the recess part 71 of the pressure receiving member 67 by the first spring 66*a*. Besides, each of the holder plates 59 receives the second roller shaft 70 of the second pressure roller 45 in the rear side pressure roller attachment groove 65, and elastically holds the second roller shaft 70 on the recess part 71 of the pressure receiving member 67 by the second spring 66*b*. In this state, the locking groove 62 of the front end part is inserted in the locked groove 57*a* of the support plate 57 of the lower frame 52, the bottom of the locking groove 62 comes in contact with the bottom of the locked groove 57*a*, and each of the holder plates 59 is swingably supported with respect to each of the side plates 55 while the contact part is made a fulcrum. That is, each of the holder plates 59 is supported to be capable of coming in contact with and being separated from the heat roller 42. By the locking between the locking groove 62 and the locked groove 57*a*, the movement of each of the holder plates 59 with respect to each of the side plates 55 is restricted in the direction orthogonal to the conveyance direction of the sheet 3.

The lower expansion part 64 of the lower end part of each of the holder plates 59 is inserted in the cutout part 56 in such a way that it can freely advance and retreat, and in the state where the rear side protrusion 63 of the rear end part thereof is put into contact with the lever 76 described next, it is swingably supported at each of the side plates 55 while its front end part is made a fulcrum.

The operation lever part 60 is provided at each of the side plates 55 to face the holder plate 59 at the rear side. Each of the operation lever parts 60 includes the lever 76, a link member 77, a cam member 78 and the like.

In the lever 76, a substantially rectangular base part 79 and an operation rod 80 extending from the base part 79 obliquely rearward are integrally formed. Besides, a swing shaft 74 engaged with an opening part of one end part of the link member 77 described next is formed at the lower end part of the base part 79 of this lever 76 so as to protrude toward the inside and the outside in the direction orthogonal to the conveyance direction of the sheet 3.

The link member 77 is formed into a substantially rectangular shape in which both sides thereof in the longitudinal direction are opened to have a substantially C-letter shape.

The cam members 78 are provided at both end parts of the after-mentioned interlocking shaft 61 in the axial direction so that relative rotation is impossible around the interlocking shaft 61, and an engagement shaft 81 engaged with the opening part of the other end part of the link member 77 is formed so as to protrude to the inside and the outside in the direction orthogonal to the conveyance direction of the sheet 3.

As shown in FIG. 2, at the inside of each of the side plates 55 in the direction orthogonal to the conveyance direction of the sheet 3, and in the state where the rear side protrusion 63 of the holder plate 59 is put into contact with the upper surface of the base part 79 of the lever 76, the swing shaft 74 extending to the outside of the base part 79 is inserted in the long hole 75 of the side plate 55. Besides, in this state, the link member 77 is disposed at each of both sides of the base part 79 of the lever 76 and the cam member 78 in the width direction, the opening part of one end of the outside link member 77 is engaged with the swing shaft 74 extending outward between the side plate 55 and the base part 79, and the opening part of the other end is engaged with the engagement shaft 81 extending to the outside of the cam member 78. The opening part of one end part of the inside link member 77 is engaged with the swing shaft 74 extending inward, and the opening part of the other end part is engaged with the engagement shaft 81 extending inward.

The interlocking shaft 61 is disposed at the rear side of the bottom wall 54 of the lower frame 52 so as to be laid between the respective side plates 55, and both end parts in the longitudinal direction are rotatably supported at the shaft support parts 73 of the respective side plates 55. As described before, the cam member 78 is provided at the inside of each of the side plates 55 so that it cannot be rotated relatively to the interlocking shaft 61.

In the pressure changeover mechanism part 46, the pressure forces per unit areas of the first pressure roller 44 and the second pressure roller 45 to the heat roller 42 can be changed over between a normal mode in which a normal paper or the like as the sheet 3 is fixed, an envelope mode in which an envelope or the like as the sheet 3 is fixed, and a release mode in which the pressures of the first pressure roller 44 and the second pressure roller 45 to the heat roller 42 are released.

Incidentally, in the following description, the changeover of the normal mode, the envelope mode and the release mode is performed in such a way that the rear cover 2*a* provided at the rear side of the main body casing 2 is put in an open state, and the operation rod so of the lever 76 is operated from the opening part. As indicated by an imaginary line in FIG. 1, the rear cover 2*a* is provided such that its lower end can be freely opened and closed with respect to the main body casing 2 through the hinge 2*b*.

In order to cause the normal mode, as shown in FIG. 5, the operator holds the operation rod 80 of each of the levers 76, and raises the operation rod 80 while swinging it forward. Then, the swing shaft 74 of the lever 6 slides upward in the long hole 75 of the side plate 55, the upper surface of the base part 79 comes in contact with the rear side protrusion 63 of the holder plate 59, and the rear side protrusion 63 is pressed upward. Accordingly, the holder plate 59 is swung so that the rear end part is moved upward while the front end part is made a fulcrum. As a result, as shown in FIG. 4, the first pressure roller 44 and the second pressure roller 45 are elastically held in the state where they are pressed to the heat roller 42 by the urging forces of the first spring 66*a* and the second spring 66*b*.

In the normal mode, setting is made such that the load of the first pressure roller 44 to the heat roller 42 becomes twice the first spring 66*a*, that is, $2\times3\times9.8$ N, and a nip width between the heat roller 42 and the first pressure roller 44 is (length, in the conveyance direction of the sheet 3 and at the width direction center part, of the contact portion between the heat roller 42 and the first pressure roller 44) becomes 3.16 mm, that is, the pressing force per unit area of the first pressure roller 44 to the heat roller 42 becomes $(2\times3\times9.8)/(3.16)=1.98\times9.8$ N/mm in terms of nip force of the first pressure roller 44 to the heat roller 42.

In order to strictly measure the pressing force per unit area of the first pressure roller 44 to the heat roller 42, for example, a following method can be used. That is, first, the whole of the sheet 3 is subjected to solid black printing, and is once stopped in the middle of the fixing operation. Thereafter, with respect to the ejected sheet 3, a brightly reflecting portion on the sheet (this reflecting portion (nip portion Y1: see FIG. 12) corresponds to the contact portion between the heat roller 42 and the first pressure roller 44 at the time when it is once stopped) is cut out, its weight is measured, and an actual area of the nip portion Y1 is obtained from the weight per unit area of the sheet 3. When the obtained area of the nip portion Y1 is divided by a force twice the spring force of the first spring 66*a*, the pressing force per unit area of the first pressure roller 44 to the heat roller 42 can be accurately obtained.

Practically, as set forth above, as the pressing force per unit area of the first pressure roller 44 to the heat roller 42, the nip force of the first pressure roller 44 to the heat roller 42 can be substituted as an approximate value thereof.

In the normal mode, setting is made such that the pressing force per unit area of the second pressure roller 45 to the heat roller 42 is higher than the pressing force per unit area of the first pressure roller 44 to the heat roller 42.

More specifically, setting is made such that the load of the second pressure roller 45 to the heat roller 42 becomes twice the second spring 66*b*, that is, 2×2×9.8 N, and a nip width between the heat roller 42 and the second pressure roller 45 (length, in the conveyance direction of the sheet 3 and at the width direction center part, of the contact portion between the heat roller 42 and the second pressure roller 45) becomes 1.5 mm, that is, the pressing force per unit area of the second pressure roller 44 to the heat roller 42 becomes (2×2×9.8)/(1.5)=2.67×9.8 N/mm in terms of nip force of the second pressure roller 45 to the heat roller 42.

The pressing force per unit area of the second pressure roller 45 to the heat roller 42 can also be accurately obtained by a similar method to the method of obtaining the pressing force per unit area of the first pressure roller 44 to the heat roller 42 and by dividing an actual area of a nip portion Y2 (see FIG. 12) between the heat roller 42 and the second pressure roller 45 by a force twice the spring force of the second spring 66*b*. However, practically, the nip force of the second pressure roller 45 to the heat roller 42 can be substituted as an approximate value thereof.

In the normal mode, the friction force of the first pressure roller 44 to the sheet 3 is the product of the spring force (2×3×9.8 N) of the two first springs 66*a* and the friction coefficient of 0.35 of the first coating layer 97, that is, 2×3×9.8 N ×0.35=2.1×9.8 N.

A friction force of the second pressure roller 45 to the sheet 3 is the product of the spring force (2×2×9.8 N) of the two second springs 66*b* and the friction coefficient of 0.6 of the second coating layer 98, that is, 2×2×9.8 N×0.6=2.4×9.8 N which is larger than the friction force of the first pressure roller 44 to the sheet 3.

Figure 6:
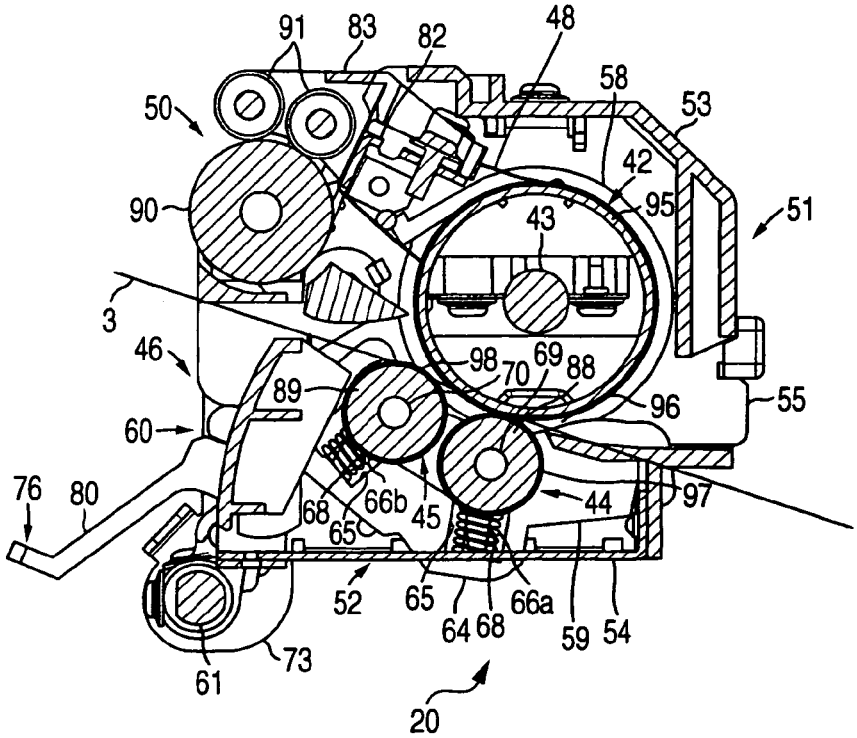
FIG. 6 is a sectional view (envelope mode) corresponding to the line IV—IV of FIG. 3.

In order to cause the envelope mode, as shown in FIG. 7, the operator holds the operation rod 80 of each of the levers 76, and swings the operation rod 80 rearward from the normal mode. Then, the swing shaft 74 of the lever 76 is rotated while the long hole 75 of the side plate 55 is made a fulcrum, the side of the base part 79 comes in contact with the rear side protrusion 63 of the holder plate 59, and the rear side protrusion 63 is slightly moved downward. Accordingly, the holder plate 59 is swung so that its rear end part is slightly moved downward while the front end part is made a fulcrum. As a result, as shown in FIG. 6, since the holder plate 59 is swung while the front end part at the conveyance direction upstream side with respect to the first roller shaft 69 of the first pressure roller 44 held at the front side pressure roller attachment groove 65 is made a fulcrum, the second pressure roller 45 is displaced more than the first pressure roller 44, and the second pressure roller 45 is separated from the heat roller 42 in the state where the first pressure roller 44 presses the heat roller 42.

In the envelope mode, both the pressing force per unit area of the first pressure roller 44 to the heat roller 42 and the pressing force per unit area of the second pressure roller 45 to the heat roller 42 become low as compared with the normal mode.

More specifically, in the envelope mode, setting is made such that the pressing force per unit area of the first pressure roller 44 to the heat roller 42 becomes about ½ of the pressing force per unit area of the first pressure roller 44 to the heat roller 42 in the normal mode. Since the second pressure roller 45 is separated from the heat roller 42, the pressing force per unit area of the second pressure roller 45 to the heat roller 42 becomes zero.

Figure 8:
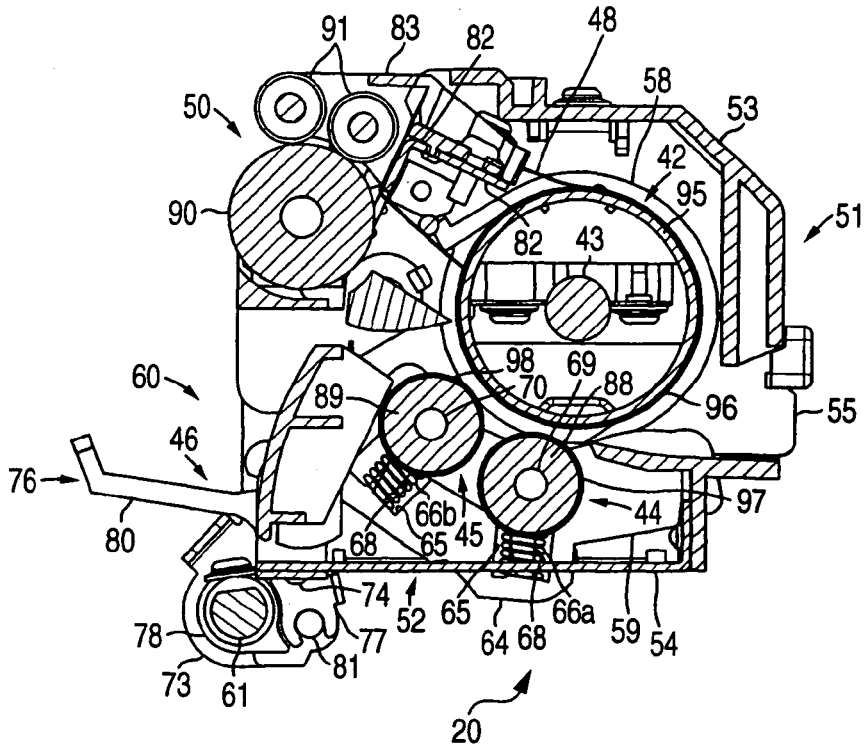
FIG. 8 is a sectional view (release mode) corresponding to the line IV—IV of FIG. 3.
Figure 9:
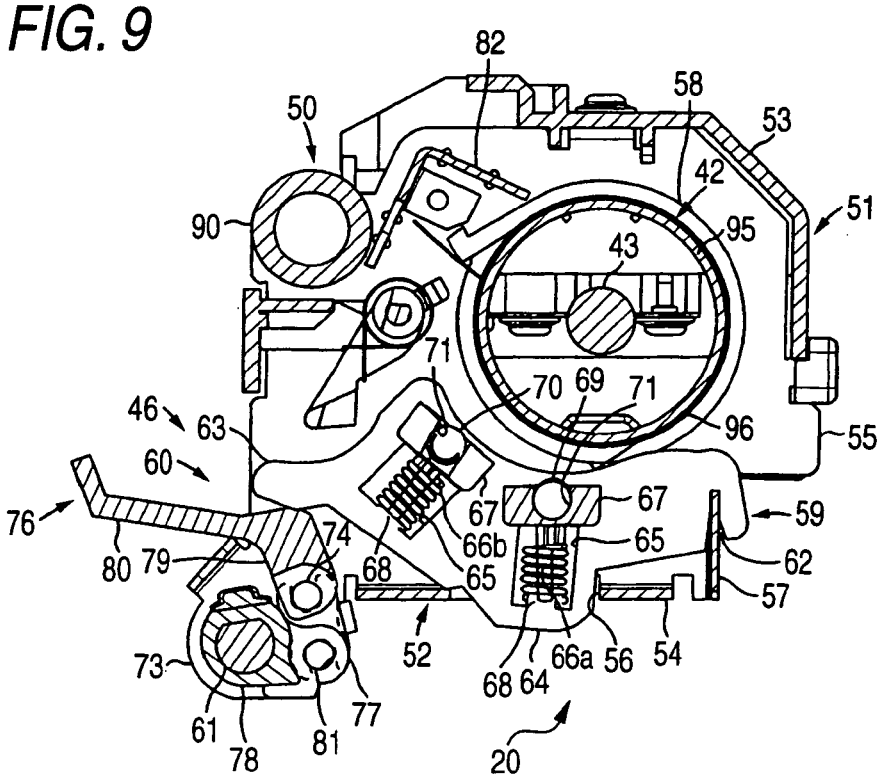
FIG. 9 is a sectional view (release mode) corresponding to the line V—V of FIG. 3.

In order to cause the release mode, as shown in FIG. 9, the operator holds the operation rod 80 of either one of the levers 76, and presses the operation rod 80 downward while swinging it rearward slightly. Then, in the state where the rear side protrusion 63 of the holder plate 59 is in contact with an inclined surface between the upper surface and the side surface of the base part 79, the swing shaft 74 of the lever 76 slides downward in the long hole 75 of the side plate 55, so that the rear side protrusion 63 is moved downward. Accordingly, the holder plate 59 is swung so that the rear end part is moved downward while the front end part is made a fulcrum, and accordingly, as shown in FIG. 8, the pressures of the first pressure roller 44 and the second pressure roller 45 to the heat roller 42 are released.

In the release mode, when the swing shaft 74 of the lever 76 slides downward in the long hole 75 of the side plate 55, since the contact shaft 81 of the cam member 78 is pressed downward through the link member 77, the interlocking shaft 61 to which the cam member 78 is provided to be unable to perform relative rotation is rotated. Thus, in the release mode, when either one of the levers 76 is operated, even if both the levers 76 are not operated, the respective holder plates 59 are interlocked by the rotation of the interlocking shaft 61 and the release mode can be realized.

As shown in FIG. 2, the plural (four) peeling pawls 47 are disposed at positions where the respective pinch roller support parts 83 are provided on the erection plate 82 of the lower frame 52 and so as to swing to be capable of coming in contact with and separating from the heat roller 42 in the state where they face the heat roller 42 from the conveyance direction downstream side to the upstream side.

The thermistor 48 is a contact type temperature sensor, and is formed to have elasticity and a flat rectangular shape, and its base end is supported at the erection plate 82 so that its free end comes in contact with the surface of the heat roller 42 at the upstream side of the contact portion between the heat roller 42 and the first pressure roller 44 in the rotation direction of the heat roller 42 and at the axial direction center portion of the heat roller 42. 20 Then, the thermistor 48 is connected to the CPU 87 as shown in FIG. 4, detects the surface temperature of the heat roller 42, and inputs a detection signal to the CPU 87. The CPU 87 controls the drive and stop of the fixing heater 43 on the basis of the detection signal from the thermistor 48, and keeps the surface temperature of the heat roller 42 at a set thermal fixation temperature.

As shown in FIG. 2, two thermostats 49 are provided along the axial direction at the upstream side of the contact portion between the heat roller 42 and the first pressure roller 44 in the rotation direction of the heat roller 42. Each of the thermostats 49 includes a bimetal deformed by heat, and when the fixing heater 43 does not normally operate due to erroneous operation of the CPU 87 or a circuit and the surface of the heat roller 42 is overheated to a temperature exceeding the set thermal fixation temperature, the thermostat cuts off the energization to the fixing heater 47 by thermal deformation of the bimetal, whereby the overheat of the heat roller is prevented.

In the fixing part 20, even in the case where the bimetal is not deformed by heat in each of the thermostats 49, when the temperature reaches a point at which the bearing member 58 is melted by further overheat of the surface of the heat roller 42, the bearing member 58 is softened, so that the heat roller 42 is moved upward by the urging force due to the pressing from the first pressure roller 44 and the second pressure roller 45. As a result, the bimetal is mechanically deformed, and accordingly, the energization to the fixing heater 47 can be cut off.

As shown in FIG. 4, the conveyance mechanism part 50 is disposed at the conveyance direction downstream side with respect to the heat roller 42, the first pressure roller 44 and the second pressure roller 45, and includes the conveyance roller 90 and the plural pinch rollers 91 disposed above the conveyance roller 90 and where face to the conveyance roller 90.

The conveyance roller 90 is configured such that a roller layer made of rubber material covers a roller-shaft made of metal, and is disposed to face the heat roller 42 across the erection frame 82 in the conveyance direction of the sheet 3. Although not shown in FIG. 2, a roller shaft of the conveyance roller 90 is inserted to the respective side plates 55, so that the conveyance roller is rotatably supported between the side plates 55 along the axial direction of the heat roller 42. Then, when power is inputted from the motor 85 (see FIG. 4), the conveyance roller 90 is driven to be rotated in an arrow direction (counterclockwise direction, see FIG. 1).

As shown in FIG. 2, plural (two) pairs of the pinch rollers 91 are provided at each of the pinch roller support parts 83 of the erection plate 82, so that they sequentially face and come in contact with the conveyance roller 90 from above in the conveyance direction of the sheet 3.

In the fixing part 20, as shown in FIG. 1, during a period when the sheet 3 conveyed from the transfer position is made to sequentially pass through while being held between the heat roller 42 and the first pressure roller 44/the second pressure roller 45, the toner image transferred onto the sheet 3 is thermally fixed, and then, in the normal mode, as shown in FIG. 4, the sheet 3 is conveyed while being held between the conveyance roller 90 and the pinch rollers 91 in the conveyance mechanism part 50, and is conveyed to a paper ejection path 92. In the envelope mode, the rear cover 2*a* is put in the open state, and as shown in FIG. 6, the sheet 3 is made to substantially linearly pass through a space below the conveyance roller 90 of the conveyance mechanism part 50 from between the heat roller 42 and the second pressure roller 45, and is taken out from the opening part of the rear cover 2*a*.

In the fixing part 20, in the case where the thermal fixation is performed in the above normal mode, the thermal fixing temperature is set to be, for example, 180° C. through the control of the fixing heater 43 by the CPU 87, and the conveyance speed of the sheet 3 is set to be, for example, 138 mm/sec through the control of the motor 85 by the CPU 87 In the case where the thermal fixation is performed in the above envelope mode, the thermal fixing temperature is set to be higher than the thermal fixing temperature in the normal mode, for example, 220° C. through the control of the fixing heater 43 by the CPU 87, and the conveyance speed of the sheet 3 is set to be lower than the conveyance speed in the normal mode, for example, 70 mm/sec through the control of the motor 85 by the CPU 87.

By providing the first pressure roller 44 and the second pressure roller 45 in the fixing part 20 in the way described above, in the case where an envelope as the sheet 3 is printed, when the normal mode is changed over to the envelope mode, in the envelope mode, both the pressing force per unit area of the first pressure roller 44 to the heat roller 42 and the pressing force per unit area of the second pressure roller 45 to the heat roller 42 can be made lower than those in the normal mode in which a normal paper or the like is fixed, and accordingly, the normal paper or the like is certainly fixed in the normal mode, and the envelope or the like can be fixed in the envelope mode while the occurrence of wrinkles is prevented.

In the case where thermal fixation is performed in the envelope mode, setting is made such that the thermal fixation temperature in the envelope mode becomes higher than the thermal fixation temperature in the normal mode through the control of the fixing heater 43 by the CPU 87. Thus, in the envelope mode, even if the pressing forces per unit areas of the first pressure roller 44 and the second pressure roller 45 become lower than those in the normal mode, the higher fixing temperature is ensured and excellent fixation can be achieved.

In the case where the thermal fixation is performed in the envelope mode, setting is made such that the conveyance speed in the envelope mode becomes lower than the conveyance speed in the normal mode through the control of the motor 85 by the CPU 87. Thus, in the envelope mode, even if the pressing forces per unit areas of the first pressure roller 44 and the second pressure roller 45 become lower than those in the normal mode, a longer fixing time is ensured and excellent fixation can be achieved.

In the fixing part 20, for example, in the case where a jam of the sheet 3 occurs between the heat roller 42 and both the first pressure roller 44 and the second pressure roller 45, by performing the changeover to the release mode, the first pressure roller 44 and the second pressure roller 45 are separated from the heat roller 42 and efficient jam processing can be performed.

Thereafter, as shown in FIG. 1, the sheet 3 sent to the paper ejection path 92 is sent to a paper ejection roller 93, and is ejected onto a paper ejection tray 94 by the paper ejection roller 93.

In the laser printer 1, as shown in FIG. 1, in order to form images on both sides of the sheet 3, a reversal conveyance part 101 is provided. The reversal conveyance part 101 includes the paper ejection roller 93, a reversal conveyance path 102, a flapper 103 and plural reversal conveyance rollers 104.

The paper ejection roller 93 has a pair of rollers, and is provided so that the forward rotation and the reverse rotation can be changed. As stated above, in the case where the sheet 3 is ejected onto the paper ejection tray 94, the paper ejection roller 93 is rotated in the forward direction, and in the case where the sheet 3 is reversed, the paper ejection roller 93 is rotated in the reverse direction.

The reversal conveyance path 102 is provided along the vertical direction so that the sheet 3 can be conveyed from the paper ejection roller 93 to the plural reversal conveyance rollers 104 disposed below the image forming section 5, its upstream side end is disposed near the paper ejection roller 93, and its downstream side end is disposed near the reversal conveyance roller 104.

The flapper 103 is swingably provided to face a branch portion between the paper ejection path 92 and the reversal conveyance path 102, and is provided to be capable of changing the conveyance direction of the sheet 3 reversed by the paper ejection roller 93 from the direction toward the paper ejection path 92 to the direction toward the reversal conveyance path 102 by excitation or non-excitation of a not-shown solenoid.

The plural reversal conveyance rollers 104 are provided above the sheet feed tray 6 in the substantially horizontal direction, the reversal conveyance roller 104 at the most upstream side is disposed near the rear end of the reversal conveyance path 102, and the reversal conveyance roller 104 at the most downstream side is disposed below the registration roller 12.

In the case where images are formed on both sides of the sheet 3, this reversal conveyance part 101 is operated as follows. That is, when the sheet 3 on one side of which an image is formed is sent by the conveyance mechanism part 50 from the paper ejection path 92 to the paper ejection roller 93, the paper ejection roller 93 is forward rotated in a state where it holds the sheet 3, and once conveys this sheet 3 to the outside (side of the paper ejection tray 94), and when most of the sheet 3 is sent to the outside and the rear end of the sheet 3 is held by the paper ejection roller 93, the forward rotation is stopped. Next, the paper ejection roller 93 is reversely rotated, the flapper 103 changes the conveyance direction so that the sheet 3 is conveyed to the reversal conveyance path 102, and the sheet 3 is conveyed to the reversal conveyance path 102 in a state where the front and the rear are reversed. Incidentally, when the conveyance of the sheet 3 is ended, the flapper 103 is changed into the original state, that is, the state in which the sheet 3 sent from the conveyance mechanism part 50 is sent to the paper ejection roller 93. Next, the sheet 3 conveyed to the reversal conveyance path 102 in the reverse direction is conveyed to the reversal conveyance rollers 104, and is sent from the reversal conveyance rollers 104 to the registration roller 12 while being reversed upward. The sheet 3 conveyed to the registration roller 12 is again sent, in the reversed state, to the image formation position after registration, whereby images are formed on both the sides of the sheet 3.

Figure 12:
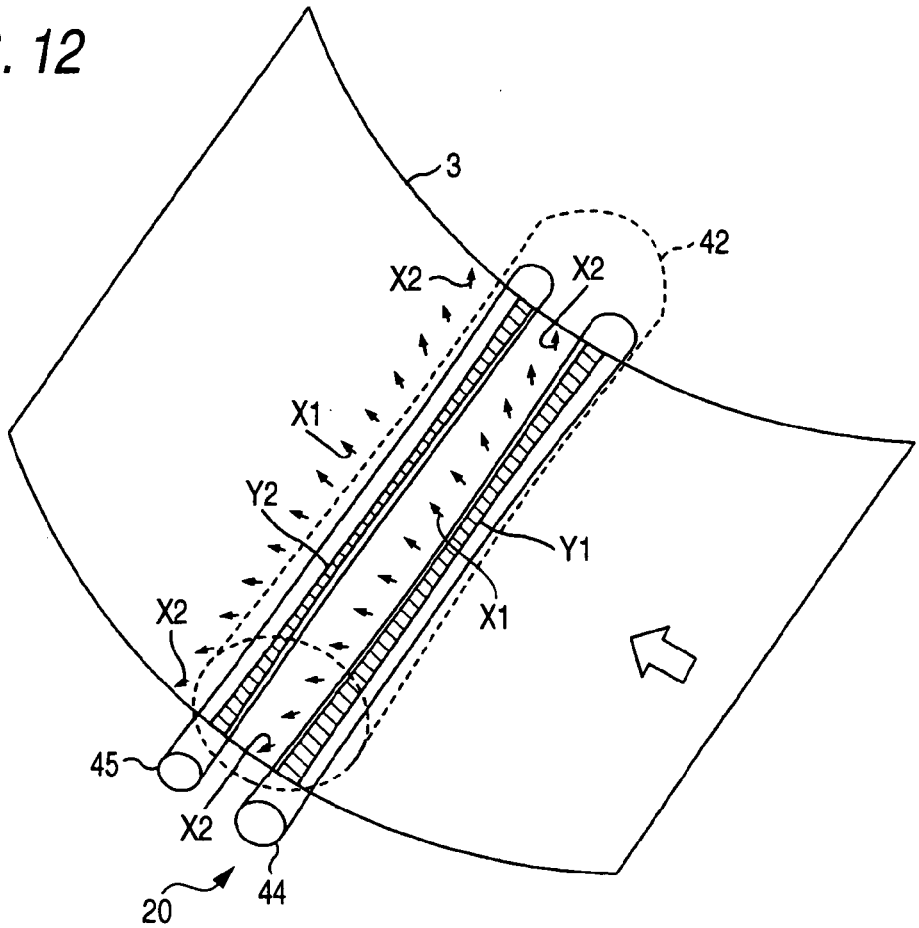
FIG. 12 is an explanatory view schematically showing a state where a sheet is conveyed in the fixing part shown in FIG. 2.

In the laser printer, as schematically shown in FIG. 12, in the fixing part 20, since the heat roller 42, the first pressure roller 44 and the second pressure roller 45 are formed into the inverted crown shape, in the conveyance of the sheet 3, the amount of conveyance of the sheet 3 becomes large from the axial direction center part to the axial direction both end parts. Thus, the sheet 3 is given not only a first conveyance force X1 along the conveyance direction of the sheet 3 from the heat roller 42 and the first pressure roller 44/the second pressure roller 45, but also a second conveyance force X2 including a component of force directed toward both sides of the sheet 3 in the width direction (direction orthogonal to the conveyance direction of the sheet 3) since the amount of conveyance of the sheet 3 at both end parts is larger than the amount of conveyance of the sheet 3 at the center part. Then, the sheet 3 pressed between the heat roller 42 and both the first pressure roller 44 and the second pressure roller 45 is pulled toward both the sides of the sheet 3 in the width direction by the second conveyance force X2. Thus, it is possible to prevent the occurrence of wrinkles toward the center part of the sheet 3 in the width direction. Especially, in this fixing part 20, the difference between the first pressure roller center part outer diameter DP1*c* (16 mm) of the first pressure roller 44 and the first pressure roller both end part outer diameter DP1*e* (16 mm+50 $\mu$m) is 50 mm, and the difference between the second pressure roller center part outer diameter DP2*c* (16 mm) of the second pressure roller 44 and the second pressure roller both end part outer diameter DP2*e* (16 mm+100 $\mu$m) is 100 mm. That is, the second pressure roller 45 is set such that the difference (100 mm) between the second pressure roller center part outer diameter DP2*c* and the second pressure roller both end part outer diameter DP2*e* of the second pressure roller 45 is larger than the difference (50 mm) between the first pressure roller center part outer diameter DP1*c* and the first pressure roller both end part outer diameter DP1*e* of the first pressure roller 44.

Accordingly, the difference in the conveyance amount of the sheet 3 between the axial direction center part and the axial direction both end part of the second pressure roller 45 can be made larger than the difference in the conveyance amount of the sheet 3 between the axial direction center part and the axial direction both end part of the first pressure roller 44. Thus, the second conveyance force X2 given from the second pressure roller 45 can be made higher than the second conveyance force X2 given from the first pressure roller 44.

As a result, when the sheet 3 is pressed between the heat roller 42 and the second pressure roller 45, as compared with the case where the sheet 3 is pressed between the heat roller 42 and the first pressure roller 44, it is more strongly pulled toward both the sides of the sheet 3 in the width direction. Thus, even if the sheet 3 is made to sequentially pass through the first pressure roller 44 and the second pressure roller 45, it is possible to prevent the occurrence of wrinkles toward the center part of the sheet 3 in the width direction.

In the fixing part 20, and in the normal mode, the friction force (2.4×9.8 N) of the second pressure roller 45 to the sheet 3 is set to be larger than the friction force (2.1×9.8 N) of the first pressure roller 44 to the sheet 3. Thus, the sliding of the second pressure roller 45 against the sheet 3 is reduced as compared with that of the first pressure roller 44, and the sheet 3 can be conveyed. As a result, since the second conveyance force X2 directed toward both the sides of the sheet 3 in the width direction can be given to the sheet 3 conveyed by the second pressure roller 45 while the sliding is reduced, it is possible to more effectively prevent the occurrence of wrinkles toward the center part of the sheet 3 in the width direction.

In the fixing part 20, and in this normal mode, since setting is made such that the pressing force per unit area of the second pressure roller 45 to the heat roller 42 (2.67×9.8 N/mm in terms of the nip force of the second pressure roller 45 to the heat roller 42) is set to be larger than the pressing force per unit area of the first pressure roller 44 to the heat roller 42 (1.98×9.8 N/mm in terms of the nip force of the first pressure roller 44 to the heat roller 42), the second conveyance force X2 is sufficiently given to the sheet 3 conveyed by the second pressure roller 45, and it is possible to more effectively prevent the occurrence of wrinkles toward the center part of the sheet 3 in the width direction.

In the fixing part 20, as described above, the first pressure roller 44 and the second pressure roller 45 are provided, so that the speed-up of the thermal fixation and the miniaturization can be realized, and it is possible to prevent the occurrence of wrinkles toward the center part of the sheet 3 in the width direction, and therefore, an excellent image can be formed.

Figure 13:
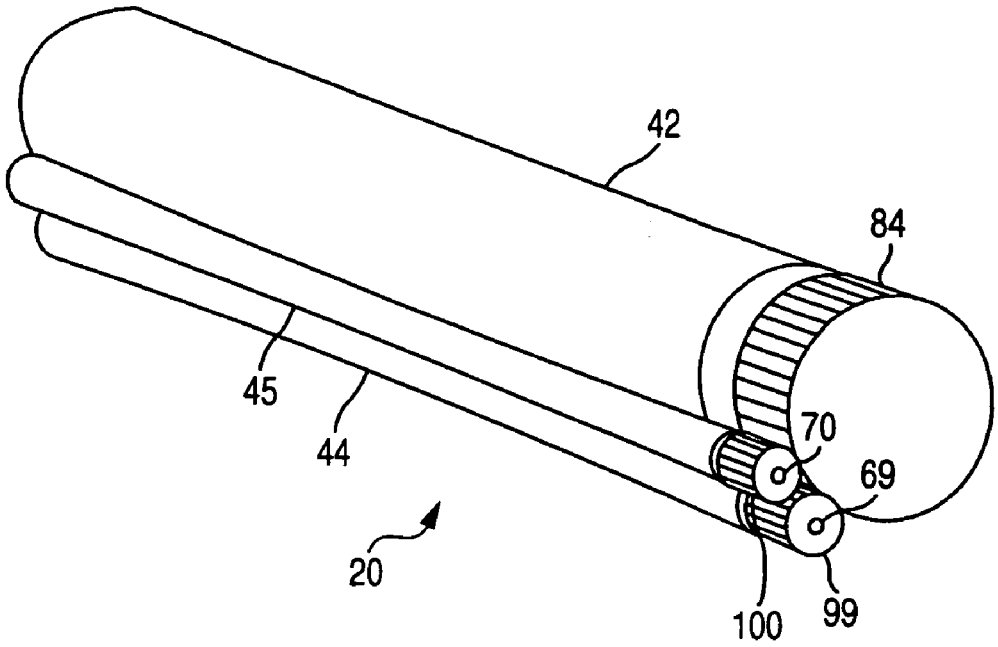
FIG. 13 is a perspective view showing another embodiment (in which a first pressure roller and a second pressure roller are driven by a motor) of the heat roller, the first pressure roller and the second pressure roller in the fixing part shown in FIG. 2.

In the above description, although the first pressure roller 44 and the second pressure roller 45 are made to follow the movement of the heat roller 42, for example, as shown in FIG. 13, a first roller shaft drive gear 99 and a second roller shaft drive gear 100 respectively engaging with the heat roller drive gear 84 are provided to the first roller shaft 69 of the first pressure roller 44 and the second roller shaft 70 of the second pressure roller 45, and the first pressure roller 44 and the second pressure roller 45 may be respectively driven by power from the motor 85 by inputting the power from the motor 85 to the first pressure roller 44 and the second pressure roller 45 through the first roller shaft drive gear 99 and the second roller shaft drive gear 100.

In the above case, setting is made such that the gear ratio of the second roller shaft drive gear 100 to the heat roller drive gear 84 becomes larger than the gear ratio of the first roller shaft drive gear 99 to the heat roller drive gear 84, and the second pressure roller 45 is driven so that the peripheral speed of the second pressure roller 45 (strictly speaking, the peripheral speed of the axial direction center part of the second pressure roller 45) becomes larger than the peripheral speed of the first pressure roller 45 (strictly speaking, the peripheral speed of the axial direction center part of the first pressure roller 44)

Since the peripheral speed of the second pressure roller 45 is higher than the peripheral speed of the first pressure roller 44, a tensile force can be given to the sheet 3 between the first pressure roller 44 and the second pressure roller 45, and it is possible to prevent the sheet 3 from being loosened between the first pressure roller 44 and the second pressure roller 45. When the sheet 3 is conveyed by the second pressure roller 45, the sheet is pulled toward both the sides of the sheet 3 in the width direction more strongly than the case of the first pressure roller 44, so that the higher second conveyance force X2 can be given to the sheet 3 conveyed by the second pressure roller 45. As a result, it is possible to more effectively prevent the occurrence of wrinkles toward the center part of the sheet 3 in the width direction.

In the case above, for example, when the peripheral speed of the first pressure roller 44 is 138 mm/sec, the peripheral speed of the second pressure roller 45 is set to about 105% of the peripheral speed of the first pressure roller 44, for example, 144.9 mm/sec.

Figure 14:
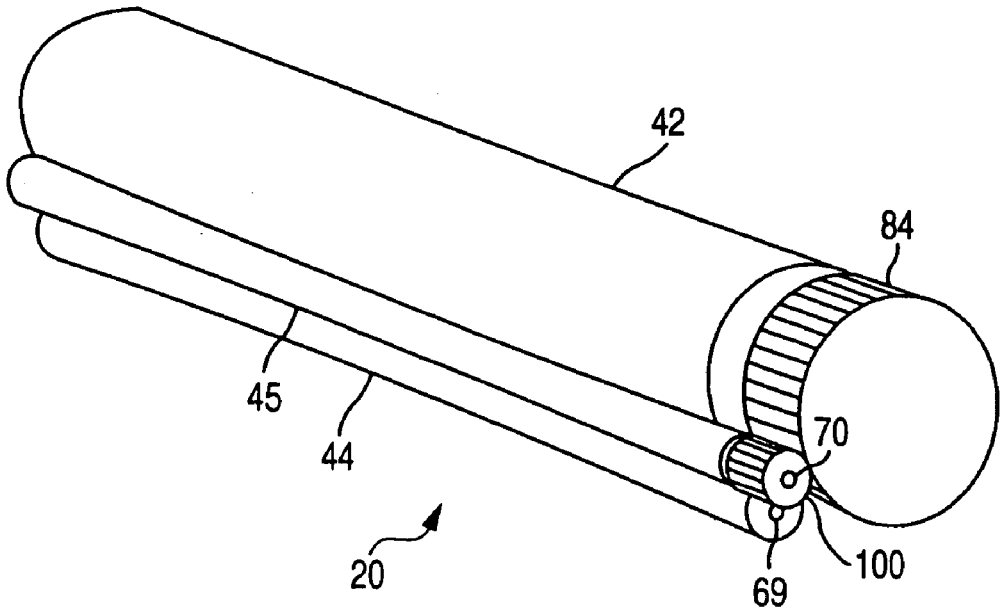
FIG. 14 is a perspective view showing another embodiment (in which a second pressure roller is driven by a motor) of the heat roller, the first pressure roller and the second pressure roller in the fixing part shown in FIG. 2.

For example, as shown in FIG. 14, the second roller shaft drive gear 100 engaging with the heat roller drive gear 84 is provided only in the second roller shaft 70 of the second pressure roller 45, and the first pressure roller 44 is made to follow the movement of the heat roller 42, and on the other hand, the second pressure roller 45 may be driven by the power from the motor 85 by inputting the power from the motor 85 to the second pressure roller 45 through the second roller shaft drive gear 100.

Since the first pressure roller 44 follows the movement of the heat roller 42, and the second pressure roller 45 is driven by the motor 85, as compared with the state where the sheet 3 is conveyed by the first pressure roller 44, in the state where the sheet 3 is conveyed by the second pressure roller 45, the amount of conveyance of the sheet 3 by the second pressure roller 45 is made larger than that by the first pressure roller 44, and the sheet can be pulled toward both the sides of the sheet 3 in the width direction. Thus, the higher second conveyance force X2 can be given to the sheet 3 conveyed by the second pressure roller 45, and it is possible to more effectively prevent the occurrence of wrinkles toward the center part of the sheet 3 in the width direction.

In the above description, although all of the heat roller 42, the first pressure roller 44 and the second pressure roller 45 in the fixing part 20 are formed into the inverted crown shape, for example, the heat roller 42 is formed into a cylindrical shape, and the first pressure roller 44 and the second pressure roller 45 may be formed into the inverted crown shape.

In the above description, although the first pressure roller center part outer diameter DPc1 (16 mm) of the first pressure roller 44 and the second pressure roller center part outer diameter DPc2 (16 mm) of the second pressure roller 45 are made equal to each other, the second pressure roller center part outer diameter DPc2 of the second pressure roller 45 may be made larger than or smaller than the first pressure roller center part outer diameter DPc1 of the first pressure roller 44.

In the above description, although the two pressure rollers of the first pressure roller 44 and the second pressure roller 45 are provided in the fixing part 20, three or more pressure rollers may be provided. In that case, the upstream side pressure roller and the downstream side pressure roller adjacent to each other in the conveyance direction of the sheet 3 correspond to the first pressing member and the second pressing member of the invention.

The fixing heater 43 maybe provided in the pressure roller. As described above, according to the invention of the first aspect, even if the first pressing member and the second pressing member are provided, it is possible to effectively prevent the occurrence of wrinkles of the fixation medium.

As described above, according to a first aspect of the invention, there is provided a thermal fixing device including: a heating member configured to be in contact with a fixation medium; a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

According to the first aspect of the invention, since the force directed toward both the sides of the fixation medium in the direction orthogonal to the conveyance direction is given to the fixation medium pressed between the heating member and both of the first pressing member and the second pressing member, the fixation medium is pulled toward both the sides of the fixation medium in the direction orthogonal to the conveyance direction. Thus, it is possible to prevent the occurrence of wrinkles toward the center part of the fixation medium in the direction orthogonal to the conveyance direction, Further, according to this configuration, since the force given from the second pressing member is higher than the force given from the first pressing member, even if at least the two pressing members are provided, it is possible to effectively prevent the occurrence of wrinkles of the fixation medium.

According to a second aspect of the invention, addition to the first aspect of the invention, the first pressing member includes a first pressing roller and the second pressing member includes a second pressing roller, wherein both of the first and the second pressing rollers have a second outer diameter at both end parts thereof, in the direction orthogonal to the conveyance direction, of an area where the fixation medium having a maximum size in which to be in contact with the first and the second pressing rollers, is larger than a first outer diameter at a center part thereof, and wherein both of the first and the second pressing rollers have outer diameters that are gradually enlarged from the center part to the both of the end parts.

According to the second aspect of the invention, the first pressing member and the second pressing member has the rollers, the second outer diameter at both the end parts, in the direction Orthogonal to the conveyance direction, of the area where the fixation medium having the maximum size comes in contact is larger than the first outer diameter at the center part of the fixation medium in the direction orthogonal to the conveyance direction, and the outer diameter gradually becomes large from the center part to both the end parts, and accordingly, the amount of conveyance of the fixation medium can be made large from the center part to both the end parts in the conveyance of the fixation medium. Thus, the force directed toward both the sides of the fixation medium in the direction orthogonal to the conveyance direction can be given to the fixation medium from the first pressing member and the second pressing member.

According to a third aspect of the invention, in addition to the second aspect of the invention, a difference between the first outer diameter and the second outer diameter of the second pressing roller is larger than a difference between the first outer diameter and the second outer diameter of the first pressing roller.

According to the third aspect of the invention, since the difference between the first outer diameter and the second outer diameter of the second pressing member is larger than the difference between the first outer diameter and the second outer diameter of the first pressing member, a difference in amount of conveyance of the fixation medium between the center part and both the end parts of the second pressing member can be made larger than a difference in amount of conveyance of the fixation medium between the center part and both the end parts of the first pressing member. As a result, the force given from the second pressing member can be made higher than the force given from the first pressing member.

According to a fourth aspect of the invention, in addition to the second aspect of the invention, the thermal fixing device further includes a driving unit that rotates the second pressing roller.

According to a fifth aspect of the invention, in addition to the fourth aspect of the invention, the first pressing roller is configured to be rotated by the rotation of the second pressing roller.

According to the fifth aspect of the invention, since the first pressing member follows the movement of the heating member, and the second pressing member is driven by the driving unit, as compared with a state where the fixation medium is conveyed by the first pressing member, in a state where the fixation medium is conveyed by the second pressure medium, the fixation medium can be pulled by the second pressing member more strongly toward both the sides in the direction orthogonal to the conveyance direction of the fixation medium. Thus, the higher force can be given to the fixation medium conveyed by the second pressing member, and even when at least the two pressing members are provided, it is possible to prevent the occurrence of wrinkles toward the center part in the direction orthogonal to the conveyance direction of the fixation medium.

According to a sixth aspect of the invention, in addition to the fourth aspect of the invention, the driving unit rotates the second pressing roller so that a peripheral speed at the center part of the center part of the second pressing roller in the direction orthogonal to the conveyance direction of the fixation medium is faster than a peripheral speed at the center part of the first pressing roller I the direction orthogonal to the conveyance direction of the fixation medium.

According to the sixth aspect of the invention, the second pressing member is driven by the driving unit so that the peripheral speed at the center part of the second pressing member in the direction orthogonal to the conveyance direction of the fixation medium is higher than the peripheral speed at the center part of the first pressing member in the direction orthogonal to the conveyance direction of the fixation medium. Thus, the conveyance amount of the fixation medium conveyed by the second pressing member can be made larger than the conveyance amount of the fixation medium conveyed by the first pressing member. As a result, it is possible to excellently prevent the occurrence of wrinkles toward the center part in the direction orthogonal to the conveyance direction of the fixation medium.

According to a seventh aspect of the invention, in addition to the first aspect of the invention, the heating member includes a heating roller, wherein the heating roller has a second outer diameter at both end parts thereof, in the direction orthogonal to the conveyance direction, of an area where the fixation medium having a maximum size in which to be in contact with the heating roller, is larger than a first outer diameter at a center part thereof, and wherein the heating roller has an outer diameter that is gradually enlarged from the center part to the both of the end parts.

According to the seventh aspect of the invention, the heating member has the roller, the second outer diameter at both the ends, in the direction orthogonal to the conveyance direction, of the area where the fixation medium having the maximum size comes in contact is larger than the first outer diameter at the center part in the direction orthogonal to the conveyance direction of the fixation medium, and the outer diameter gradually becomes large from the center part to both the end parts, and accordingly, the conveyance amount of the fixation medium can be made large from the center part to both the end parts in the conveyance of the fixation medium. Thus, the force directed toward both the sides of the fixation medium in the direction orthogonal to the conveyance direction can be given to the fixation medium from the heating member, and it is possible to excellently prevent the occurrence of wrinkles toward the center part in the direction orthogonal to the conveyance direction of the fixation medium.

According to an eighth aspect of the invention, in addition to the first aspect of the invention, a friction force of the second pressing member is larger than a friction force of the first pressing member.

According to the eighth aspect of the invention, the force directed toward both the sides of the fixation medium in the direction orthogonal to the conveyance direction can be given to the fixation medium conveyed by the second pressure member, while the sliding is reduced. Thus, it is possible to excellently prevent the occurrence of wrinkles toward the center part of the fixation medium in the direction orthogonal to the conveyance direction.

According to a ninth aspect of the invention, in addition to the first aspect of the invention, a pressing force per unit area of the second pressing member is larger than a pressing force per unit area of the first pressing member.

According to the ninth aspect of the invention, the force is sufficiently given to the fixation medium conveyed by the second pressure member, and it is possible to excellently prevent the occurrence of wrinkles toward the center part of the fixation medium in the direction orthogonal to the conveyance direction.

According to a tenth aspect of the invention, there is provided a thermal fixing device including: a heating member configured to be in contact with a fixation medium; a first pressing roller disposed to face the heating member and presses the fixation medium to the heating member, the first pressing roller having a second outer diameter at both end parts thereof, in a direction orthogonal to the conveyance direction, of an area where the fixation medium having a maximum size in which to be in contact with the first pressing roller, the second outer diameter being larger than a first outer diameter at a center part thereof; and a second pressing roller disposed to face the heating member at a position downstream in the conveyance direction with respect to the first pressing roller and presses the fixation medium to the heating member, the second pressing roller having a second outer diameter at both end parts thereof, in the direction orthogonal to the conveyance direction, of an area where the fixation medium having a maximum size in which to be in contact with the second pressing roller, the second outer diameter being larger than a first outer diameter at a center part thereof, and wherein a difference between the first outer diameter and the second outer diameter of the second pressing roller is larger than a difference between the first outer diameter and the second outer diameter of the first pressing roller.

According to the tenth aspect of the invention, the first pressing member and the second pressing member have the rollers, the second outer diameter at both the end parts, in the direction orthogonal to the conveyance direction, of the area where the fixation medium having the maximum size comes in contact is larger than the first outer diameter at the center part of the fixation medium in the direction orthogonal to the conveyance direction, and the outer diameter gradually becomes large from the center part to both the end parts, and accordingly, the amount of conveyance of the fixation medium can be made large from the center part to both the end parts in the conveyance of the fixation medium. Besides, since the difference between the first outer diameter and the second outer diameter of the second pressing member is larger than the difference between the first outer diameter and the second outer diameter of the first pressing member, a difference in amount of conveyance of the fixation medium between the center part and both the end parts of the second pressing member can be made larger than a difference in amount of conveyance of the fixation medium between the center part and both the end parts of the first pressing member. Thus, force directed toward both sides in the direction orthogonal to the conveyance direction of the fixation medium can be given to the fixation medium from the first pressing member and the second pressing member, and the force given from the second pressing member can be made higher than the force given from the first pressing member. As a result, it is possible to prevent the occurrence of wrinkles toward the center part in the direction orthogonal to the conveyance direction of the fixation medium.

According to an eleventh aspect of the invention, in addition to the tenth aspect of the invention, the thermal fixing device further includes a driving unit that rotates the second pressing roller.

According to a twelfth aspect of the invention, in addition to the eleventh aspect of the invention, the first pressing roller is configured to be rotated by the rotation of the second pressing roller.

According to the twelfth aspect of the invention, since the first pressing member follows the movement of the heating member, and the second pressing member is driven by the driving unit, as compared with a state where the fixation medium is conveyed by the first pressing member, in a state where the fixation medium is conveyed by the second pressure medium, the fixation medium can be pulled by the second pressing member more strongly toward both the sides in the direction orthogonal to the conveyance direction of the fixation medium. Thus, the higher force can be given to the fixation medium conveyed by the second pressing member, and even when at least the two pressing members are provided, it is possible to prevent the occurrence of wrinkles toward the center part in the direction orthogonal to the conveyance direction of the fixation medium.

According to a thirteenth aspect of the invention, in addition to the eleventh aspect of the invention, the driving unit rotates the second pressing roller so that a peripheral speed at the center part of the center part of the second pressing roller in the direction orthogonal to the conveyance direction of the fixation medium is faster than a peripheral speed at the center part of the first pressing roller I the direction orthogonal to the conveyance direction of the fixation medium.

According to the thirteenth aspect of the invention, the second pressing member is driven by the driving unit so that the peripheral speed at the center part of the second pressing member in the direction orthogonal to the conveyance direction of the fixation medium is higher than the peripheral speed at the center part of the first pressing member in the direction orthogonal to the conveyance direction of the fixation medium. Thus, the conveyance amount of the fixation medium conveyed by the second pressing member can be made larger than the conveyance amount of the fixation medium conveyed by the first pressing member. As a result, it is possible to excellently prevent the occurrence of wrinkles toward the center part in the direction orthogonal to the conveyance direction of the fixation medium.

According to a fourteenth aspect of the invention, in addition to the tenth aspect of the invention, the heating member includes a heating roller, wherein the heating roller has a second outer diameter at both end parts thereof, in the direction orthogonal to the conveyance direction, of an area where the fixation medium having a maximum size in which to be in contact with the heating roller, is larger than a first outer diameter at a center part thereof, and wherein the heating roller has an outer diameter that is gradually enlarged from the center part to the both of the end parts.

According to the fourteenth aspect of the invention, the heating member has the roller, the second outer diameter at both the ends, in the direction orthogonal to the conveyance direction, of the area where the fixation medium having the maximum size comes in contact is larger than the first outer diameter at the center part in the direction orthogonal to the conveyance direction of the fixation medium, and the outer diameter gradually becomes large from the center part to both the end parts, and accordingly, the conveyance amount of the fixation medium can be made large from the center part to both the end parts in the conveyance of the fixation medium. Thus, the force directed toward both the sides of the fixation medium in the direction orthogonal to the conveyance direction can be given to the fixation medium from the heating member, and it is possible to excellently prevent the occurrence of wrinkles toward the center part in the direction orthogonal to the conveyance direction of the fixation medium.

According to an fifteenth aspect of the invention, in addition to the tenth aspect of the invention, a friction force of the second pressing roller is larger than a friction force of the first pressing roller.

According to the fifteenth aspect of the invention, the force directed toward both the sides of the fixation medium in the direction orthogonal to the conveyance direction can be given to the fixation medium conveyed by the second pressure roller, while the sliding is reduced. Thus, it is possible to excellently prevent the occurrence of wrinkles toward the center part of the fixation medium in the direction orthogonal to the conveyance direction.

According to a sixteenth aspect of the invention, in addition to the tenth aspect of the invention, a pressing force per unit area of the second pressing roller is larger than a pressing force per unit area of the first pressing roller.

According to the sixteenth aspect of the invention, the force is sufficiently given to the fixation medium conveyed by the second pressure roller, and it is possible to excellently prevent the occurrence of wrinkles toward the center part of the fixation medium in the direction orthogonal to the conveyance direction.

According to the seventeenth aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a heating member configured to be in contact with the fixation medium; a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

According to an eighteenth aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a heating member configured to be in contact with a fixation medium; a first pressing roller disposed to face the heating member and presses the fixation medium to the heating member, the first pressing roller having a second outer diameter at both end parts thereof, in a direction orthogonal to the conveyance direction, of an area where the fixation medium having a maximum size in which to be in contact with the first pressing roller, the second outer diameter being larger than a first outer diameter at a center part thereof; and a second pressing roller disposed to face the heating member at a position downstream in the conveyance direction with respect to the first pressing roller and presses the fixation medium to the heating member, the second pressing roller having a second outer diameter at both end parts thereof, in the direction orthogonal to the conveyance direction, of an area where the fixation medium having a maximum size in which to be in contact with the second pressing roller, the second outer diameter being larger than a first outer diameter at a center part thereof, and wherein a difference between the first outer diameter and the second outer diameter of the second pressing roller is larger than a difference between the first outer diameter and the second outer diameter of the first pressing roller.

According to the seventeenth and the eighteenth aspect of the invention, an excellent image can be formed.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A thermal fixing device comprising:

a heating member configured to be in contact with a fixation medium;

a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

2. The thermal fixing device according to claim 1, wherein the first pressing member comprises a first pressing roller and the second pressing member comprises a second pressing roller, wherein both of the first and the second pressing rollers have a second outer diameter at both end parts thereof, in the direction orthogonal to the conveyance direction, of an area where the fixation medium having a maximum size in which to be in contact with the first and the second pressing rollers, is larger than a first outer diameter at a center part thereof, and wherein both of the first and the second pressing rollers have outer diameters that are gradually enlarged from the center part to the both of the end parts.

3. The thermal fixing device according to claim 2, wherein a difference between the first outer diameter and the second outer diameter of the second pressing roller is larger than a difference between the first outer diameter and the second outer diameter of the first pressing roller.

4. The thermal fixing device according to claim 2 further comprising a driving unit that rotates the second pressing roller.

5. The thermal fixing device according to claim 4, wherein the first pressing roller is configured to be rotated by the rotation of the second pressing roller.

6. The thermal fixing device according to claim 4, wherein the driving unit rotates the second pressing roller so that a peripheral speed at the center part of the center part of the second pressing roller in the direction orthogonal to the conveyance direction of the fixation medium is faster than a peripheral speed at the center part of the first pressing roller I the direction orthogonal to the conveyance direction of the fixation medium.

7. The thermal fixing device according to claim 1, wherein the heating member comprises a heating roller, wherein the heating roller has a second outer diameter at both end parts thereof, in the direction orthogonal to the conveyance direction, of an area where the fixation medium having a maximum size in which to be in contact with the heating roller, is larger than a first outer diameter at a center part thereof, and wherein the heating roller has an outer diameter that is gradually enlarged from the center part to the both of the end parts.

8. The thermal fixing device according to claim 1, wherein a friction force of the second pressing member is larger than a friction force of the first pressing member.

9. The thermal fixing device according to claim 1, wherein a pressing force per unit area of the second pressing member is larger than a pressing force per unit area of the first pressing member.

10. A thermal fixing device comprising:

a heating member configured to be in contact with a fixation medium;

a first pressing roller disposed to face the heating member and presses the fixation medium to the heating member, the first pressing roller having a second outer diameter at both end parts thereof, in a direction orthogonal to the conveyance direction, of an area where the fixation medium having a maximum size in which to be in contact with the first pressing roller, the second outer diameter being larger than a first outer diameter at a center part thereof; and a second pressing roller disposed to face the heating member at a position downstream in the conveyance direction with respect to the first pressing roller and presses the fixation medium to the heating member, the second pressing roller having a second outer diameter at both end parts thereof, in the direction orthogonal to the conveyance direction, of an area where the fixation medium having a maximum size in which to be in contact with the second pressing roller, the second outer diameter being larger than a first outer diameter at a center part thereof, and wherein a difference between the first outer diameter and the second outer diameter of the second pressing roller is larger than a difference between the first outer diameter and the second outer diameter of the first pressing roller.

11. The thermal fixing device according to claim 10 further comprising a driving unit that rotates the second pressing roller.

12. The thermal fixing device according to claim 11, wherein the first pressing roller is configured to be rotated by the rotation of the second pressing roller.

13. The thermal fixing device according to claim 11, wherein the driving unit rotates the second pressing roller so that a peripheral speed at the center part of the center part of the second pressing roller in the direction orthogonal to the conveyance direction of the fixation medium is faster than a peripheral speed at the center part of the first pressing roller I the direction orthogonal to the conveyance direction of the fixation medium.

14. The thermal fixing device according to claim 10, wherein the heating member comprises a heating roller, wherein the heating roller has a second outer diameter at both end parts thereof, in the direction orthogonal to the conveyance direction, of an area where the fixation medium having a maximum size in which to be in contact with the heating roller, is larger than a first outer diameter at a center part thereof, and wherein the heating roller has an outer diameter that is gradually enlarged from the center part to the both of the end parts.

15. The thermal fixing device according to claim 10, wherein a friction force of the second pressing roller is larger than a friction force of the first pressing roller.

16. The thermal fixing device according to claim 10, wherein a pressing force per unit area of the second pressing roller is larger than a pressing force per unit area of the first pressing roller.

17. An image forming apparatus comprising:

a sheet feeding section configured to feed a sheet as a fixation medium; and an image forming section having a thermal fixing device and configured to form an image on the sheet fed by the sheet feeding section, wherein the thermal fixing device comprises:

a heating member configured to be in contact with the fixation medium;

a first pressing member disposed to face the heating member and applies a force directed toward both sides of the fixation medium in a direction orthogonal to a conveyance direction of the fixation medium by pressing the fixation medium to the heating member; and a second pressing member disposed to face the heating member at a position downstream in the conveyance direction with respect to the first pressing member and applies a force, which is larger than the force of the first pressing member, directed toward both sides of the fixation medium in a direction orthogonal to the conveyance direction.

18. An image forming apparatus comprising:

a sheet feeding section configured to feed a sheet as a fixation medium; and an image forming section having a thermal fixing device and configured to form an image on the sheet fed by the sheet feeding section, wherein the thermal fixing device comprises:

a heating member configured to be in contact with a fixation medium;

a first pressing roller disposed to face the heating member and presses the fixation medium to the heating member, the first pressing roller having a second outer diameter at both end parts thereof, in a direction orthogonal to the conveyance direction, of an area where the fixation medium having a maximum size in which to be in contact with the first pressing roller, the second outer diameter being larger than a first outer diameter at a center part thereof; and a second pressing roller disposed to face the heating member at a position downstream in the conveyance direction with respect to the first pressing roller and presses the fixation medium to the heating member, the second pressing roller having a second outer diameter at both end parts thereof, in the direction orthogonal to the conveyance direction, of an area where the fixation medium having a maximum size in which to be in contact with the second pressing roller, the second outer diameter being larger than a first outer diameter at a center part thereof, and wherein a difference between the first outer diameter and the second outer diameter of the second pressing roller is larger than a difference between the first outer diameter and the second outer diameter of the first pressing roller.

* * * * *